US009445168B2

(12) United States Patent
Li et al.

(10) Patent No.: US 9,445,168 B2
(45) Date of Patent: Sep. 13, 2016

(54) ELECTRONIC DEVICE AND DIRECTION SWITCHING METHOD OF THE ELECTRONIC DEVICE

(71) Applicant: Lenovo (Beijing) Co., Ltd., Beijing (CN)

(72) Inventors: Tao Li, Beijing (CN); Dejun Wang, Beijing (CN); Yifei Song, Beijing (CN); Shaoping Peng, Beijing (CN); Shunyong Yang, Beijing (CN)

(73) Assignee: LENOVO (BEIJING) CO., LTD., Haidian District, Beijing (CN)

( * ) Notice: Subject to any disclaimer, the term of this patent is extended or adjusted under 35 U.S.C. 154(b) by 467 days.

(21) Appl. No.: 13/784,993

(22) Filed: Mar. 5, 2013

(65) Prior Publication Data

US 2013/0230186 A1 Sep. 5, 2013

(30) Foreign Application Priority Data

Mar. 5, 2012 (CN) ..... CN201210055713
Jun. 29, 2012 (CN) ..... CN201210226634

(51) Int. Cl.
*H04R 1/00* (2006.01)
*H04R 3/00* (2006.01)
*H04R 5/04* (2006.01)

(52) U.S. Cl.
CPC *H04R 1/00* (2013.01); *H04R 3/00* (2013.01); *H04R 5/04* (2013.01); *H04R 2499/11* (2013.01)

(58) Field of Classification Search
CPC ..... H04R 1/00
USPC ..... 381/92, 123; 379/433.03, 432, 420; 455/418, 556.1, 575.1
See application file for complete search history.

(56) References Cited

U.S. PATENT DOCUMENTS 3,592,966 A * 7/1971 Hansen ..... 379/443
5,844,985 A * 12/1998 Kulberg et al. ..... 379/433.13

(Continued)

FOREIGN PATENT DOCUMENTS

CN 1642177 A 7/2005
CN 1929512 3/2007

(Continued)

OTHER PUBLICATIONS

First Office Action dated Jul. 3, 2015 from corresponding Chinese Application No. CN 201210055713.9 (16 pages including English translation).

(Continued)

*Primary Examiner* — William Deane, Jr.
(74) *Attorney, Agent, or Firm* — Brinks Gilson & Lione; G. Peter Nichols

(57) ABSTRACT

An electronic device and a direction switching method are described. The electronic device includes a housing having a first end and a second end, an audio input unit and an audio output unit. The electronic device has at least a first working direction and a second working direction, the direction from said first end to said second end is a reference direction when the electronic device is in the first working direction; and the direction from the second end to the first end is the reference direction when the electronic device is in the second working direction, wherein the audio input unit in a working state is located at the second end when the electronic device is in the first working direction; and the audio input unit in the working state is located at the first end when the electronic device is in the second working direction.

22 Claims, 18 Drawing Sheets

(56) References Cited

U.S. PATENT DOCUMENTS

| | | | | |
|---|---|---|---|---|
| 7,181,251 | B2 * | 2/2007 | Stohr et al. | 455/566 |
| 7,707,877 | B2 * | 5/2010 | Nishizu et al. | 73/149 |
| 8,326,370 | B2 * | 12/2012 | DeLuca | 455/569.1 |
| 8,588,434 | B1 * | 11/2013 | Morrill | 381/123 |
| 8,712,393 | B2 * | 4/2014 | Kim et al. | 455/418 |
| 2005/0026652 | A1 * | 2/2005 | Kawamura | H04M 1/0247 455/556.1 |
| 2005/0110874 | A1 | 5/2005 | Song | |
| 2005/0136977 | A1 * | 6/2005 | Levy | H04B 1/385 455/557 |
| 2008/0146289 | A1 * | 6/2008 | Korneluk et al. | 455/569.1 |
| 2009/0256861 | A1 * | 10/2009 | Sacher et al. | 345/650 |
| 2011/0045812 | A1 * | 2/2011 | Kim et al. | 455/418 |
| 2011/0316768 | A1 * | 12/2011 | McRae | 345/156 |
| 2013/0156209 | A1 * | 6/2013 | Visser | H04M 1/035 381/66 |
| 2014/0173667 | A1 * | 6/2014 | Koizumi et al. | 725/62 |

FOREIGN PATENT DOCUMENTS

| | | | |
|---|---|---|---|
| CN | 201315612 | Y | 9/2009 |
| CN | 101562905 | A | 10/2009 |
| CN | 201667668 | U | 12/2010 |
| CN | 102326188 | A | 1/2012 |
| EP | 1615407 | A1 | 1/2006 |
| EP | 1 855 507 | | 11/2007 |

OTHER PUBLICATIONS

First Office Action dated Dec. 26, 2014 out of corresponding Chinese priority Application No. 201210226634.X (15 pages including English translation).

Second Office Action dated Sep. 17, 2015 out of corresponding Chinese priority Application No. 201210226634.X (15 pages including English translation).

Third Office Action dated Apr. 7, 2016 out of corresponding Chinese priority Application No. 201210226634.X (15 pages including English translation).

* cited by examiner

300

300

500

600

700

800

160

1200

1300

1400

1500

1600

ELECTRONIC DEVICE AND DIRECTION SWITCHING METHOD OF THE ELECTRONIC DEVICE

This application claims priority to CN201210055713.9 filed on Mar. 5, 2012 and CN201210226634. X filed on Jun. 29, 2012, the entire contents of each are incorporated herein by reference.

BACKGROUND

The present invention relates to the field of computer technology, and more particularly, it relates to an electronic device and a direction switching method of the electronic device.

In recent years, electronic devices such as tablet PCs (PAD), mobile phones, multimedia players, personal digital assistants (PDAs) and the like are more and more popular. However, currently, the use of any electronic device all has a direction limit.

For example, in the prior art, a user must hold and use a mobile phone in a correct posture or gesture, so that he/she can perform operations such as making a call, sending a text message, photographing, etc. When the user uses a mobile phone in a wrong way (upside down) because of negligence, or a child uses a mobile phone in a wrong way because of not understanding the principle of the mobile phone, it may result in that the user's mouth cannot be aligned with the microphone of the mobile phone and at the same time the user's ear cannot be aligned with the speaker of the mobile phone, causing that operations such as making a call cannot be completed normally.

Accordingly, inventors of the present invention have found that electronic devices on the market have certain inconvenience to operations of the user.

Furthermore, in the prior art, with the rapid development of electronic devices, especially mobile terminals, current mobile terminals also have a variety of entertainment functions, such as playing music or video, in addition to basic communication functions, such as answering a call.

A current mobile terminal is generally provided with one handset (receiver) and one loudspeaker or megaphone (speaker). When answering a call, the user uses the receiver to receive the caller's voice; when using the mobile terminal to play audio and video, the user uses the speaker to play audio. However, stereo playing effect cannot be achieved by using a single speaker when playing audio.

Thus, in the prior art, in order to achieve stereo playing effect of audio in a mobile terminal, the most widely used method at present is that one more speaker is added in the mobile terminal, so that stereo playing of audio is implemented via two speakers.

However, using the method in the prior art not only increases manufacturing cost of an electronic device, but also extends use space required by the electronic device.

SUMMARY

In order to solve the above technical problems, according to one aspect of the present invention, there is provided an electronic device, said electronic device comprising: a housing having a first end and a second end; an audio input means provided within said housing, used for inputting first audio information, and including at least one audio input unit; and an audio output means provided within said housing, used for outputting second audio information, and including at least one audio output unit, said electronic device has at least a first working direction and a second working direction, the direction from said first end to said second end is a reference direction when said electronic device is in said first working direction; and the direction from said second end to said first end is the reference direction when said electronic device is in said second working direction, wherein the audio input unit in a working state is located at said second end when said electronic device is in said first working direction; and the audio input unit in the working state is located at said first end when said electronic device is in said second working direction.

According to another aspect of the present invention, there is provided a direction switching method of an electronic device, said electronic device comprising: a housing having a first end and a second end; an audio input means provided within said housing, used for inputting first audio information, and including at least one audio input unit; and an audio output means provided within said housing, used for outputting second audio information, and including at least one audio output unit, said electronic device has at least a first working direction and a second working direction, the direction from said first end to said second end is a reference direction when said electronic device is in said first working direction; and the direction from said second end to said first end is the reference direction when said electronic device is in said second working direction, wherein said method comprises: causing the audio input unit in a working state to be located at said second end when said electronic device is in said first working direction; and causing the audio input unit in the working state to be located at said first end when said electronic device is in said second working direction.

As compared with the prior art, with the electronic device and the direction switching method thereof according to the present invention being adopted, when using the electronic device, if the working direction of the electronic device changes, it is possible to cause the audio input unit in the working state to change correspondingly, so that a vocal section (such as the user's mouth or other voice sources) can always be aligned with the audio input unit of the electronic device. Accordingly, the present invention can enable the user to use the electronic device without considering the working direction of the electronic device, thereby increasing convenience when using the electronic device, and enhancing user experience.

Other features and advantages of the present invention will be set forth in the subsequent descriptions in the specification and part of them will become apparent from the specification, or will be learned by implementing the present invention. The objectives and other advantages of the present invention can be realized and attained through the structures particularly indicated in the specification, the claims, and the drawings attached thereto.

BRIEF DESCRIPTION OF THE DRAWINGS

The drawings are used to provide a further understanding of the present invention, and constitute a portion of the specification, they are for explaining the present invention together with the embodiments of the present invention, and do not function as limiting the present invention. In the drawings.

DETAILED DESCRIPTION

Figure 1:
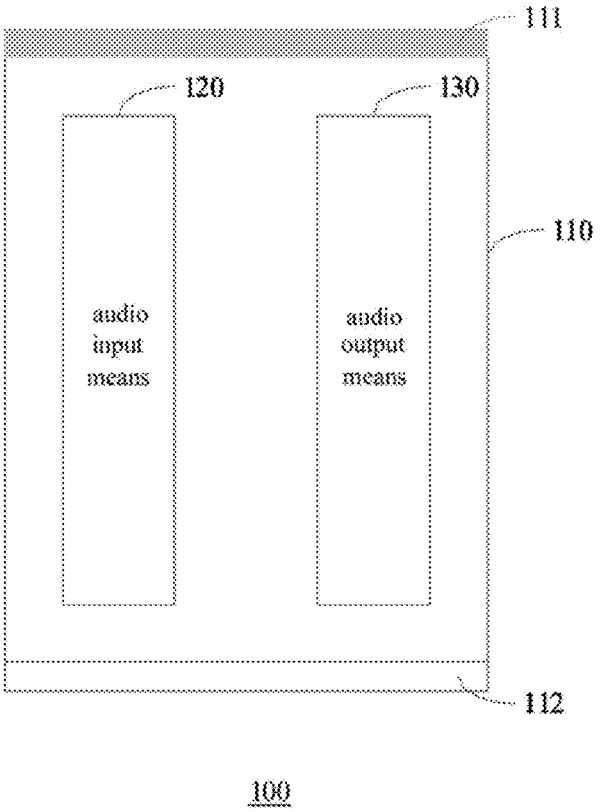
FIG. 1 illustrates an electronic device according to the present invention.

The respective embodiments according to the present invention will be described in detail with reference to the drawings. Herein it should be noted that, in the drawings, components having substantially the same or similar structures and functions are endowed with the same reference signs, and repeated descriptions for them will be omitted.

Hereinafter, an electronic device and a direction switching method thereof according to the present invention are to be described with reference to FIGS. 1 and 2.

FIG. 1 illustrates an electronic device according to the present invention.

As shown in FIG. 1, the electronic device 100 according to the present invention comprises:

a housing 110 having a first end 111 and a second end 112;

an audio input means 120 provided within the housing 110, used for inputting first audio information, and including at least one audio input unit; and an audio output means 130 provided within the housing 110, used for outputting second audio information, and including at least one audio output unit, and the electronic device 100 has at least a first working direction and a second working direction, the direction from the first end to the second end is a reference direction when the electronic device 100 is in the first working direction; and the direction from the second end to the first end is the reference direction when the electronic device 100 is in the second working direction, wherein the audio input unit 120 in a working state is located at the second end when the electronic device 100 is in the first working direction; and the audio input unit 120 in the working state is located at the first end when the electronic device 100 is in the second working direction.

Figure 2:
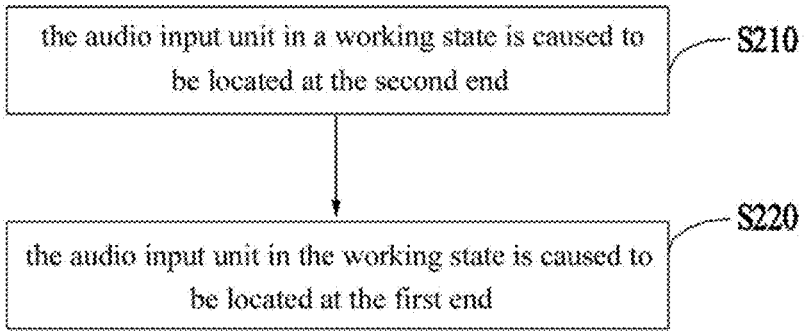
FIG. 2 illustrates a direction switching method according to the present invention.

FIG. 2 illustrates a direction switching method according to the present invention.

As shown in FIG. 2, the direction switching method according to the present invention is applied to the electronic device 100 as shown in FIG. 1. And said method comprises:

in step S210, the audio input unit in the working state is caused to be located at the second end when the electronic device 100 is in the first working direction; and in step S220, the audio input unit in the working state is caused to be located at the first end when the electronic device 100 is in the second working direction.

Thus it can be seen that, with the electronic device and the direction switching method thereof according to the present invention being adopted, when using the electronic device, if the working direction of the electronic device changes, it is possible to cause the audio input unit in the working state to change correspondingly, so that a vocal section (such as the user's mouth or other voice sources) can always be aligned with the audio input unit of the electronic device. Accordingly, the present invention can enable the user to use the electronic device without considering the working direction of the electronic device, thereby increasing convenience when using the electronic device, and enhancing user experience.

Hereinafter, an electronic device and a direction switching method thereof according to a first embodiment of the present invention are to be described with reference to FIGS. 3 and 4. In the first embodiment of the present invention, a mobile phone is described as an example of the electronic device, the mobile telephone at least can be used to receive a user's voice signal through a microphone, convert it to a wireless signal and transmit to a base station, and can be also used to receive a wireless signal from the base station, convert it to a voice signal and transmit to the user through a speaker.

It should be noted that, although herein the present invention is explained by applying the electronic device and the direction switching method thereof according to the present invention to a mobile phone, one of skill in the art can understand that the present invention is not limited thereto, and it may be also applied to other electronic devices, e.g., Tablet PCs, multimedia players, fixed telephones, recording equipments, personal digital assistants, and so on.

Figure 3:
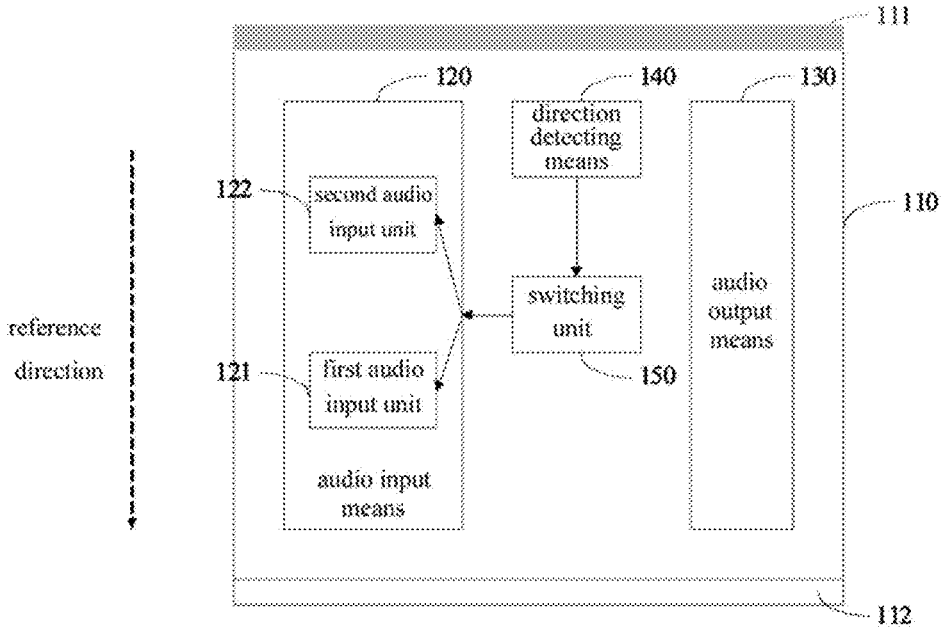
FIG. 3 illustrates an electronic device in a first working direction according to a first embodiment of the present invention.
Figure 4:
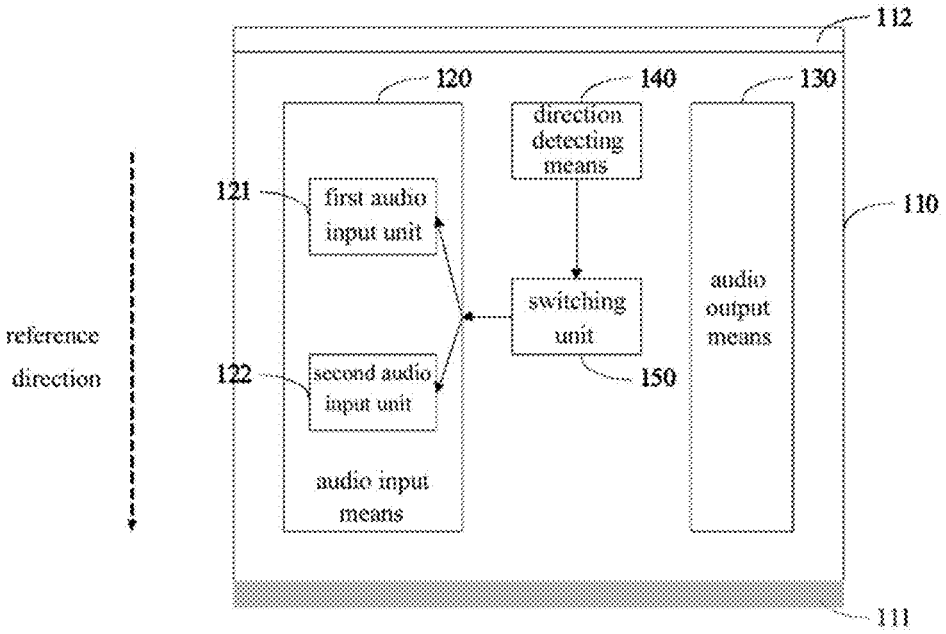
FIG. 4 illustrates an electronic device in a second working direction according to the first embodiment of the present invention.

FIG. 3 illustrates an electronic device in a first working direction according to the first embodiment of the present invention, and FIG. 4 illustrates an electronic device in a second working direction according to the first embodiment of the present invention.

As shown in FIG. 3 or 4, the electronic device according to the first embodiment of the present invention, for example, is a mobile phone 300, which comprises: a housing 110 having a first end 111 and second end 112. In order to distinguish, the first end 111 is denoted using a rectangular area filled with gray shade, and the second end 112 is denoted using a rectangular area without being filled.

The mobile phone 300 further comprises: an audio input means 120 provided within the housing 110, used for inputting first audio information, and including a first audio input unit 121 and a second audio input unit 122. The first audio input unit 121 located at the second end 112, and the second audio input unit 122 located at the first end 111.

The mobile phone 300 further comprises: an audio output means 130 provided within the housing 110, used for outputting second audio information, and including at least one audio output unit.

The mobile phone 300 has at least a first working direction and a second working direction, the direction from the first end 111 to the second end 112 is a reference direction (e.g., the direction of gravity) when the mobile phone 300 is in the first working direction; and the direction from the second end 112 to the first end 111 is the reference direction when the mobile phone 300 is in the second working direction. As shown by the arrow in FIG. 3 or 4, the reference direction may be selected to be a direction extending from an upper portion of the figure to a lower portion of the figure. In this situation, when the mobile phone 300 is in the first working direction, the first end 111 is in the upper portion of the figure, and the second end is in the lower portion of the figure, as shown in FIG. 3; when the mobile telephone 300 is in the second working direction, the first end 111 is in the lower portion of the figure, and the second end is in the upper portion of the figure, as shown in FIG. 4.

In addition, the mobile phone 300 further comprises: a direction detecting means 140 for detecting whether the mobile telephone 300 is in the first working direction or the second working direction; and a switching unit 150 for switching the first audio input unit 121 to a working state when the direction detecting means 140 detects that the mobile phone 300 is in the first working direction, so as to input the first audio information; and switching the second audio input unit 122 to the working state when the direction detecting means 140 detects that the mobile phone 300 is in the second working direction, so as to input the first audio information.

As described in the Background Art, the use of a conventional mobile telephone has a direction limit. For example, usually a user uses a mobile phone in a standing state. At this time, normally the user must hold the mobile phone vertically, i.e., the display plane of the mobile phone is maintained vertical to the ground plane, the side having the display screen faces the use's face, the end having a speaker remains in the upper portion and close to the user's ear, and the end having a microphone remains in the lower portion and close to the user's mouth. That is to say, the direction of from the first end to the second end of the mobile phone is the direction of gravity.

However, when the user does not use a mobile phone with the correct posture as mentioned above, for example, when the user takes the mobile phone upside down (i.e., the speaker remains in the lower portion, and the microphone remains in the upper portion) due to negligence, it will result in that the user's mouth in the lower portion of the user's face cannot be aligned with the microphone of the mobile telephone, so that the mobile phone cannot normally receive a voice signal uttered by the user.

In the first embodiment of the present invention, the audio input means 120 includes the first audio input unit 121 located at the second end 112 (i.e., a lower portion in the proper use direction) of the mobile phone 300 and the second audio input unit 122 located at the first end 111 (i.e., an upper portion in the proper use direction) of the mobile phone 300.

In this situation, the direction detecting means 140 detects in real time, randomly, or periodically the direction that the mobile phone 300 is currently in. When the direction detecting means 140 finds out that the user is using the mobile phone 300 with a correct posture, it notifies the switching unit 150 to switch the second audio input unit 122 to a non-working state, and switch the first audio input unit 121 to a working state, so as to receive a voice signal uttered by the user with a minimum noise. Contrarily, when the direction detecting means 140 finds out that the user is holding the mobile phone in an opposite direction and making a call, it notifies the switching unit 150 to switch the first audio input unit 121 to the non-working state, and switch the second audio input 122 to the working state, so as to receive the user's voice signal having a minimum attenuation.

Preferably, when the direction detecting means 140 finds out that the user is using the mobile phone 300 in a correct posture, it may not switch the second audio input unit 122 to the non-working state, but to maintain it in the working state, so as to receive background noise in the surrounding environment, and thereby removing the environmental noise from the user's voice signal received by the first audio input unit 121 in a processing circuit, thus improving call quality. Likewise, when the direction detecting means 140 finds out that the user is holding the mobile phone in an opposite direction and making a call, it may also cause the first audio input unit 121 to maintain in the working state, so as to receive the background noise.

Thus it can be seen that, with the mobile phone and the direction switching method of the mobile phone according to the first embodiment of the present invention being adopted, it is possible to detect the working direction that the mobile phone is currently in by the direction detecting means, switch the audio input unit at the second end of the mobile phone to the working state when the mobile telephone is currently in the first working direction, and switch the audio input unit at the first end of the mobile phone to the working state when the mobile telephone is currently in the second working direction, so that the user's mouth can always be aligned with one audio input unit to receive an audio signal uttered by the user. Accordingly, the first embodiment of the present invention can enable the user to use the mobile phone without considering the working direction of the mobile phone, so that audio signals such as voice and the like can be input to the mobile phone, thus avoiding the problem that the user cannot normally use the mobile phone because of holding the mobile phone in a wrong direction.

Hereinafter, mobile telephones according to the respective examples of the first embodiment of the present invention are to be described with reference to FIGS. 5 to 8.

Figure 5:
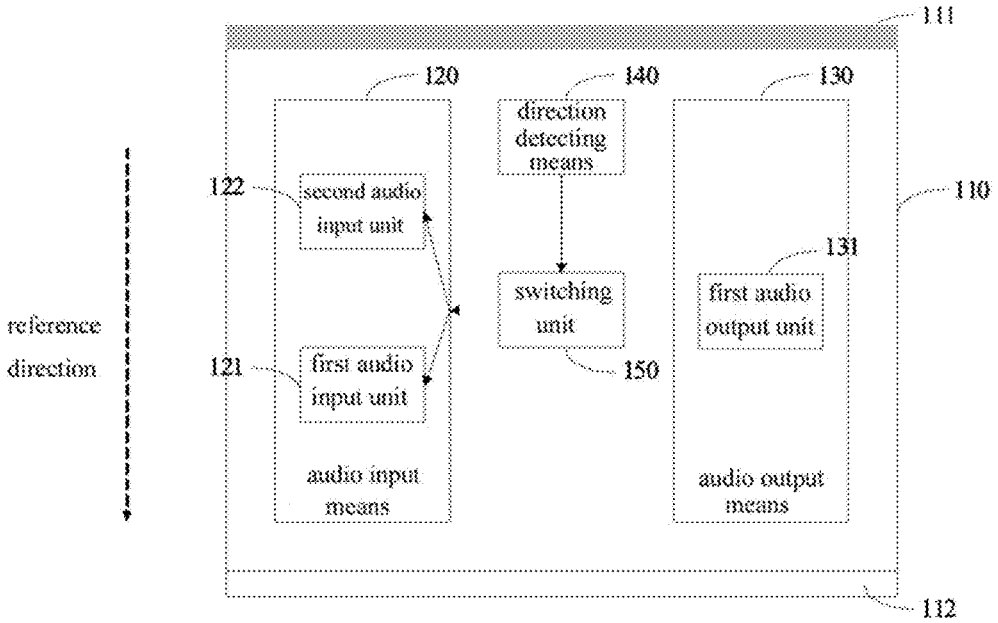
FIG. 5 illustrates a mobile telephone in a first example of the first embodiment according to the present invention.

FIG. 5 illustrates a mobile telephone 500 in a first example of the first embodiment according to the present invention.

Similar to the mobile telephone according to the first embodiment of the present invention as shown in FIG. 3 or 4, as shown in FIG. 5, the mobile telephone 500 in the first example of the first embodiment according to the present invention also comprises: a housing 110, a first audio input unit 121 and a second audio input unit 122, an audio output means 130, a direction detecting means 140, and a switching unit 150, wherein, in particular, the audio output means 130 includes a first audio output unit 131 for outputting the second audio information in a first volume.

In the first example of the first embodiment, the first audio output unit 131 may be a loudspeaker located in any position of the mobile phone 500. In addition, the direction detecting means 140 may be a direction sensor, such as a gravity sensor, which uses a cantilever shifter made with elastic sensing elements together with an energy storage spring made with elastic sensing elements to drive an electrical contact, so as to complete the conversion from gravity change to an electrical signal.

It should be noted that, although herein the direction sensor is explained with the gravity sensor, one of skill in the art can understand that, the present invention is not limited thereto, and it may also use other sensors such as a gyroscope etc. The gyroscope differs from the gravity sensor in that: the gravity sensor can only measure the acceleration due to the gravity, and then calculate an inclination angle of the electronic device relative to the horizontal plane; and the gyroscope can further measure actions such as rotation, deflection etc., so as to accurately analyze and determine the user's actual operations to the electronic device.

As described in the first embodiment, when the user is in a standing state, he/she is usually using a mobile phone in a situation that the direction from the first end to the second end of the mobile phone is the direction of gravity. In this situation, the switching unit 150 switches the first audio input unit 121 to a working state when the gravity sensor 140 finds out that the user is using the mobile phone 500 in the direction of gravity, and the switching unit 150 switches the second audio input unit 122 to the working state when the gravity sensor 140 finds out that the user is using the mobile phone 500 in a direction opposite to the direction of gravity, so as to receive voice uttered by the user. Meanwhile, no matter whether the direction from the first end to the second end of the mobile telephone is the direction of gravity, the mobile phone 500 will always maintain the first audio output unit 131 in the working state, so as to output a voice signal of a counterpart talker received by the mobile phone from a base station in a manner of loudspeaking (in a high volume).

Preferably, it may also possible to decrease an output volume of the voice signal by lowering the voice intensity output by the loudspeaker via an attenuating circuit (not shown), so as to prevent discomfort of the user's ear and/or leakage of conversations due to a too large sound from the loudspeaker.

In addition, preferably, the mobile phone 500 in the first example of the first embodiment according to the present invention may further include a display processing unit (not shown), used for dynamically adjusting a display interface of the display screen. For example, when the gravity sensor 140 finds out that the user is using the mobile phone 300 in a correct posture, i.e., when the direction from the first end to the second end of the mobile phone 500 is the direction of gravity, it notifies the display processing unit to adjust the user interface displayed on the display screen of the mobile phone 500 to display in accordance with the direction from the first end to the second end. When the direction from the second end to the first end of the mobile phone 500 is the direction of gravity, the gravity sensor 140 notifies the display processing unit to adjust the user interface to display in accordance with the direction from the second end to the first end.

Further, different from the situation described in the first embodiment, in addition to using the mobile phone in the standing state, the user may also use the mobile phone in a lying state. However, when the user is in the lying state, it is obviously impossible to detect the working direction in which the mobile telephone is currently in by the direction sensor. At this time, preferably, the mobile telephone of the present invention is set as: when the direction detector detects that the mobile phone is in the direction of gravity or the direction opposite to the direction of gravity, activating the switching unit to switch the first audio input unit 121 and the second audio input unit 122, and when the direction sensor detects that the mobile phone is in a direction vertical to the direction of gravity or other directions, disabling the switching unit, so as to avoid generating a wrong switching. Thereafter, the mobile phone of the present invention may be further set as: enabling the direction sensor to periodically detect the working direction of the mobile phone, and reactivating the direction switching unit to switch when the mobile phone once again is in the direction of gravity or in the direction opposite to the direction of gravity.

Thus, with the mobile phone in the first example of the first embodiment according to the present invention being adopted, it is possible to detect the working direction that the mobile phone is currently in by the direction sensor, and switch the audio input unit in the lower portion and close to the user's mouth to the working state, so as to receive an audio signal uttered by the user, and always maintain the loudspeaker in the working state so as to output an audio signal to the user in the manner of loudspeaking.

Figure 6:
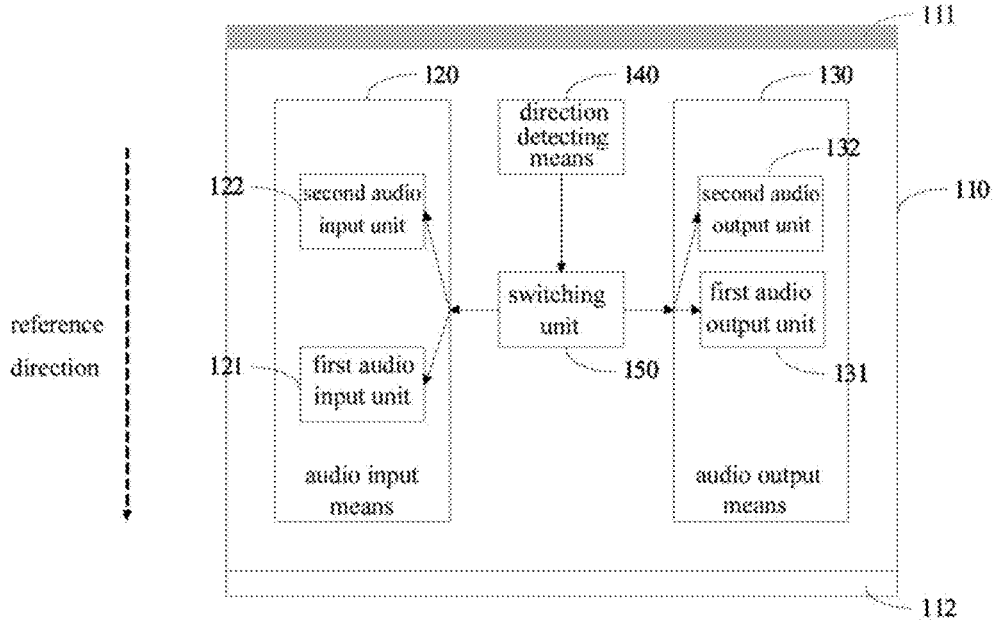
FIG. 6 illustrates a mobile telephone in a second example of the first embodiment according to the present invention.

FIG. 6 illustrates a mobile phone 600 in a second example of the first embodiment according to the present invention.

Similar to the mobile telephone according to the first embodiment of the present invention as shown in FIG. 3 or 4, as shown in FIG. 6, the mobile telephone 600 in the second example of the first embodiment according to the present invention also comprises: a housing 110, a first audio input unit 121 and a second audio input unit 122, an audio output means 130, a direction detecting means 140, and a switching unit 150, wherein, in particular, the audio output means 130 includes a first audio output unit 131 and a second audio output unit 132. The first audio output unit 131 is for outputting the second audio information in a first volume when it is in a working state; and the second audio output unit is located at the first end 111, and is for outputting the second audio information in a second volume when it is in the working state.

In the second example of the first embodiment, the first audio output unit 131 may be a loudspeaker located in any position of the mobile phone 600, and the second audio output unit 132 may be an ordinary handset located at the first end 111 of the mobile phone 600. In addition, the direction detecting means 140 may be a holding posture detecting unit, which is used to detect the working direction that the electronic device is currently in by determining the manner that the user holds the electronic device.

Different from the situation described in the first embodiment, in addition to using the mobile phone in a standing state, the user may also use the mobile phone in a lying state. At this time, the user usually holds the mobile phone as follows: maintaining the display plane of the mobile phone to be perpendicular with the ground plane (in a state that the user is lying flat on the back) or maintaining the display plane of the mobile phone to be horizontal with the ground plane (in a state that the user is lying on the side), the side having a display screen faces the user's face, the end having a speaker is maintained in a direction towards the user's head top and close to the user's ear, and the end having a microphone is maintained in a direction towards the user's lower jaw and close to the user's mouth. That is to say, the direction from the first end to the second end of the mobile phone is the horizontal direction.

In this situation, the holding posture detecting unit 140 detects the user's handprint patterns on the mobile phone by a sensor arranged on an outer surface of the mobile phone, and determines the direction that mobile telephone is in by analyzing the handprint patterns. For example, when finding out that the thumb of the user faces the first end 111, the holding posture detecting unit 140 determines that the first end 111 is located in the direction towards the user's head top, and the second end 112 is located in the direction towards the user's jaw. At this time, the switching unit 150 switches the first audio input unit 121 close to the user's mouth to a working state to receive voice uttered by user, switches the first audio output unit 131 close to the user's mouth to a non-working state, and switches the second audio output unit 132 close to the user's ear to the working state to output an audio signal from a counterpart talker to the user via a handset.

Contrarily, for example, when finding out that the user's thumb faces the second end 111, the holding posture detecting unit 140 determines that the first end 111 is located in the direction towards the user's jaw, and the second end 112 is located in the direction towards the user's head top. At this time, the switching unit 150 switches the second audio input unit 122 close to the user's mouth to the working state to receive the voice uttered by the user, switch the second audio output unit 132 close to the user's mouth to the non-working state, and switches the first audio output unit 131 located at any position to the working state to output an audio signal to the user in a manner of loudspeaking.

Obviously, this example can be applied not only to a situation that the user is in the lying state, but also to other situations that the user is in the standing state or even an inclined state. The specific descriptions for other situations are omitted for conciseness.

Alternatively, the holding gesture detecting unit 140 can also determine the direction that the mobile phone or other electronic devices are in by detecting the user's holding position. For example, in the case of a mobile phone with a large size, when the user's holding position is close to the second end 112, the holding gesture detecting unit 140 determines that the first end 111 is located in the direction towards the user's head top, and the second end 112 is located in the direction towards the user's jaw. Contrarily, when the user's holding position is close to the first end 111, the holding gesture detecting unit 140 determines that the first end 111 is located in the direction towards the user's jaw, and the second end 112 is located in the direction towards the user's head top.

It should be noted that, although herein handprint patterns and holding positions are taken to explain the holding gesture detecting unit, one of skill in the art can understand that the present invention is not limited thereto, and it may also use other sensors that detects using other features.

Thus, with the mobile phone in the second example of the first embodiment according to the present invention being adopted, it is possible to detect the working direction that the mobile phone is currently in by the holding gesture detecting unit, switch the audio input unit close to the user's mouth to the working state to receive an audio signal uttered by the user, and switch the audio output unit close to the user' ear or a loudspeaker to the working state to output an audio signal to the user via a handset or in a manner of loudspeaking.

Figure 7:
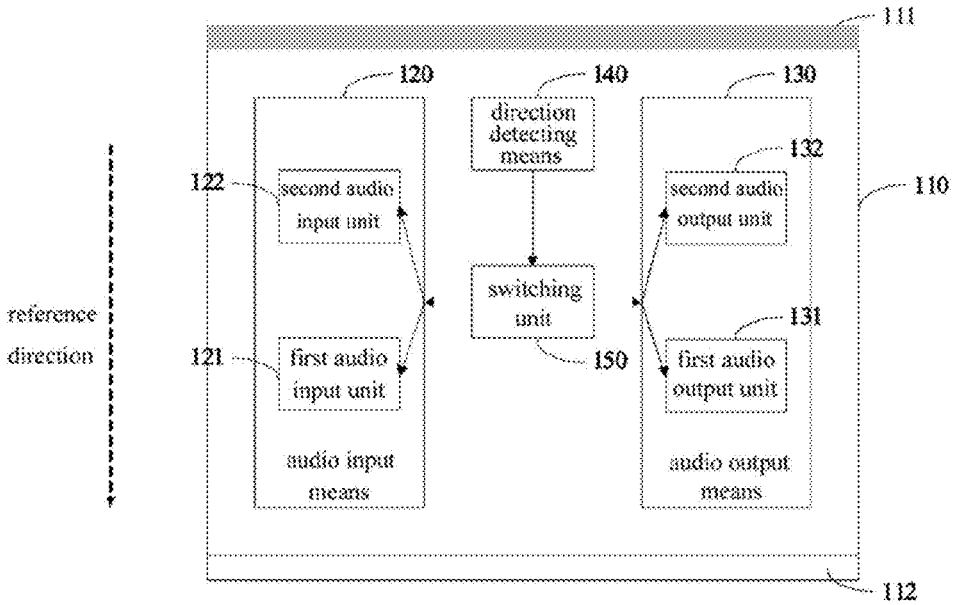
FIG. 7 illustrates a mobile phone in a third example of the first embodiment according to the present invention.

FIG. 7 illustrates a mobile phone 700 in a third example of the first embodiment according to the present invention.

Similar to the mobile telephone according to the first embodiment of the present invention as shown in FIG. 3 or 4, as shown in FIG. 7, the mobile telephone 700 in the third example of the first embodiment according to the present invention also comprises: a housing 110, a first audio input unit 121 and a second audio input unit 122, an audio output means 130, a direction detecting means 140, and a switching unit 150, wherein, in particular, the audio output means 130 includes a first audio output unit 131 and a second audio output unit 132. The first audio output unit 131 is located at the second end 112, and is for outputting the second audio information in a second volume when it is in a working state; and the second audio output unit is located at the first end 111, and is for outputting the second audio information in a second volume when it is in the working state.

In the third example of the first embodiment, the first audio output unit 131 may be an ordinary handset located at the second end 112 of the mobile telephone 700, and the second audio output unit 132 may be an ordinary handset located at the first end 111 of the mobile telephone 700. In addition, the direction detecting means 140 may be an intensity comparing unit, which is used to detect the working direction that the electronic device is currently in by determining the intensity of an audio signal uttered by the user.

As described in the first embodiment, when the user is in a standing state, he/she usually uses the mobile phone in a situation that the direction from the first end to the second end of the mobile phone is the direction of gravity. In this situation, the intensity comparing unit 140 instructs the switching unit 150 to first switch both the first audio input unit 121 and the second audio input unit 122 to the working state, so as to respectively receive a first voice signal and a second voice signal to which the voice uttered by the user corresponds, and compare their intensity. When the intensity of the first voice signal is greater than that of the second voice signal, it indicates that the user's mouth is closer to the first audio input unit 121 as compared with the second audio input unit 122, in other words, the intensity comparing unit 140 determines that the first end 111 is located in a direction towards the user's head top, and the second end 112 is located in a direction towards the user's jaw. At this time, the switching unit 150 maintains the first audio input unit 121 close to the user's mouth in the working state to receive voice uttered by the user, and switches the second audio input unit 122 close to the user's ear to a non-working state to reduce power consumption, or maintains the second audio input unit 122 in the working state to remove environmental noise; and switches the first audio output unit 131 close to the user's mouth to the non-working state, and switches the second audio output unit 132 close to the user's ear to the working state to output an audio signal from a counterpart talker to the user via a handset.

Contrarily, when the intensity of the first voice signal is less than that of the second voice, it indicates that the user's mouth is further away from the first audio input unit 121 as compared with the second audio input unit 122, in other words, the intensity comparing unit 140 determines that the first end 111 is located in the direction towards the user's jaw, and the second end 112 is located in the direction towards the user's head top. At this time, the switching unit 150 maintains the second audio input unit 122 close to the user's mouth in the working state to receive voice uttered by the user; switches the second audio output unit 132 close to the user's mouth to the non-working state, and switches the first audio output unit 131 close to the user's ear to the working state to output an audio signal from a counterpart talker to the user via the handset.

Obviously, this example can be applied to not only a situation that the user is in the lying state, but also to other situations that the user is in the standing state or even an inclined state. The specific descriptions for other situations are omitted for conciseness.

Thus, with the mobile phone in the third example of the first embodiment according to the present invention being adopted, it is possible to detect the working direction that the mobile phone is currently in via the intensity comparing unit, switch the audio input unit close to the user's mouth to the working state to receive an audio signal uttered by the user, and switch the audio output unit close to the user's ear to the working state to output an audio signal to the user via a handset.

Figure 8:
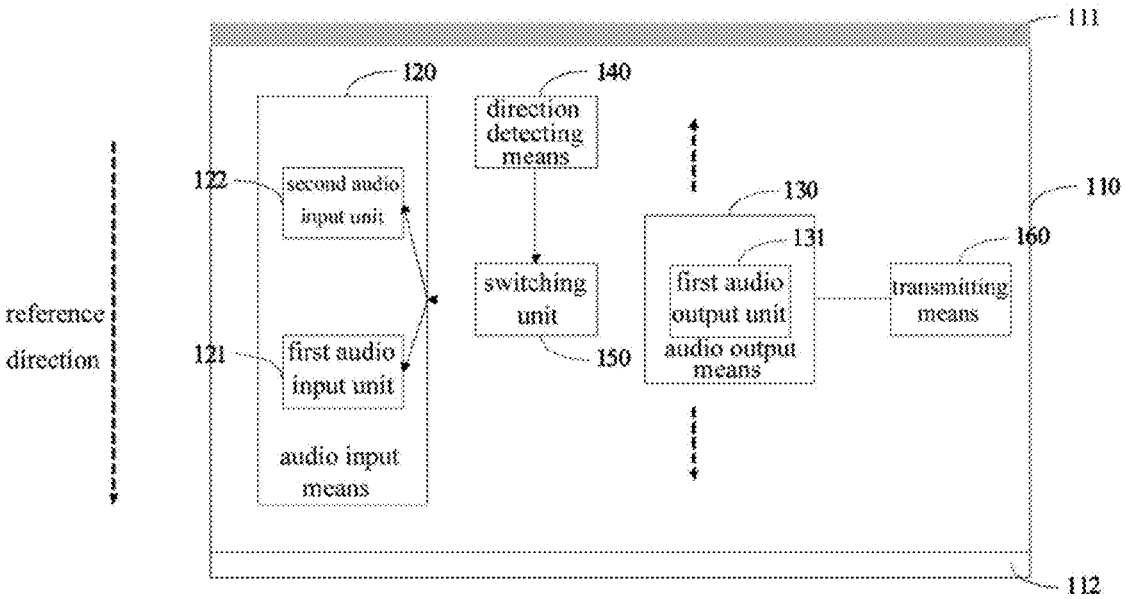
FIG. 8 illustrates a mobile phone in a fourth example of the first embodiment according to the present invention.

FIG. 8 illustrates a mobile phone 800 in a fourth example of the first embodiment according to the present invention.

Similar to the mobile telephone according to the first embodiment of the present invention as shown in FIG. 3 or 4, as shown in FIG. 8, the mobile telephone 800 in a fourth example of the first embodiment according to the present invention also comprises: a housing 110, a first audio input unit 121 and a second audio input unit 122, an audio output means 130, a direction detecting means 140, and a switching unit 150, wherein, in particular, the audio output means 130 includes a first audio output unit 131. The first audio output unit 131 is for outputting the second audio information in a second volume. In addition, the mobile telephone 800 further comprises a transmitting means 160, which is provided within the housing 110, and transmits the first audio output unit 131 to the first end 111 when the mobile telephone 800 is in a first working direction and the first audio output unit 131 to the second end 112 when the mobile telephone 800 is in a second working direction.

In the fourth example of the first embodiment, the first audio output unit 131 may be an ordinary handset that can move to the first end 111 and second end 112. In addition, combining configuration of the transmitting means 160 and the first audio output unit 131 may be implemented by adopting the following three implementing modes, so as to always maintain the audio output unit in the vicinity of the user's ear by a variety of ways, to output an audio signal to the user via a handset.

Hereinafter, three implementing modes of combining configuration of the transmitting means 160 and the first audio output unit 131 of the mobile phone 800 in the fourth example of the first embodiment according to the present invention are to be described with reference to FIGS. 9 to 11.

Figure 9:
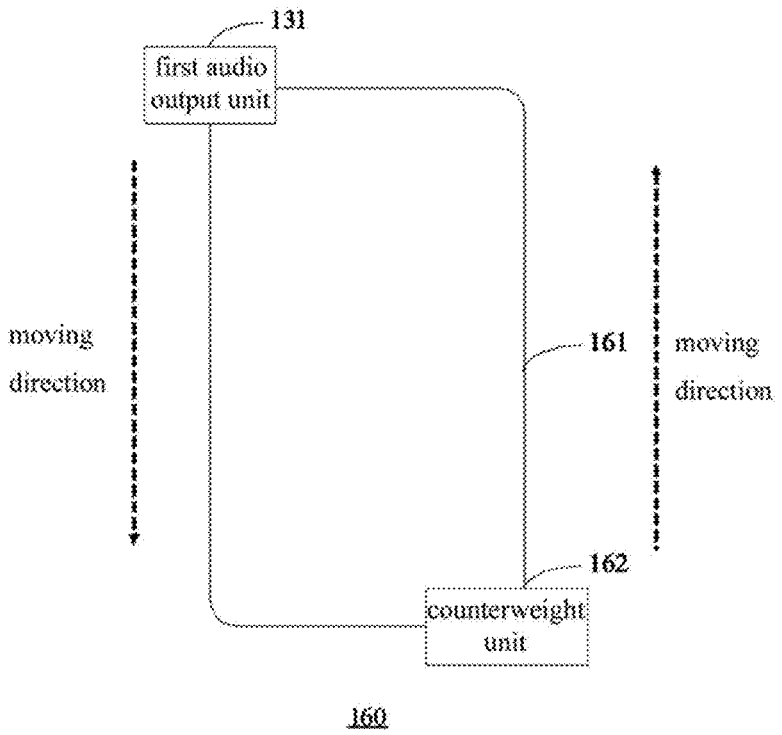
FIG. 9 illustrates a first implementing mode of the fourth example of the first embodiment according to the present invention.

FIG. 9 illustrates a first implementing mode of combining configuration of the transmitting means 160 and the first audio output unit 131 of the mobile phone 800 in the fourth example of the first embodiment according to the present invention.

As shown in FIG. 9, the transmitting means 160 according to the first implementing mode includes: a slide track 161, which is provided within the transmitting means 160 and on which the first audio output unit 131 is installed; and a counterweight unit 162 installed on the slide track 161, wherein the mass of the counterweight unit 161 is greater than that of the first audio output unit 131.

In the first implementing mode, the sliding track 161 may be a chain, a hinge, a slide rail, etc. that slides freely. In addition, the first audio output unit 131 may be an ordinary handset fixedly installed (e.g., welding, riveting, paste, etc.) on the slide track 161 and moving along the slide track 161.

As described in the first embodiment, when the user is in a standing state, he/she is usually using a mobile phone in a situation that the direction from the first end to the second end of the mobile phone is the direction of gravity. In this situation, for example, when the gravity sensor 140 finds out that the user is using the mobile phone 500 in the direction of gravity, the switching unit 150 switches the first audio input unit 121 located in a lower portion of the mobile phone 800 to a working state, so as to receive voice uttered by the user. Meanwhile, since the mass of the counterweight unit 161 is greater than that of the first audio output unit 131, the counterweight unit 162 drags the first audio output unit 131 to slide on the slide track 161, so that the first audio output unit 131 is maintained in an upper portion (i.e., the first end 111) of the mobile phone 800 while the counterweight unit 162 is maintained in a lower portion (i.e., the second end 112) of the mobile phone 800, so as to output an audio signal from a counterpart talker to the user via a handset.

Contrarily, when the gravity sensor 140 finds out that the user is using the mobile phone 800 in a direction opposite to the direction of gravity, the switching unit 150 switches the second audio input unit 122 in the lower portion of the mobile phone 800 to the working state, so as to receive voice uttered by the user. Meanwhile, the counterweight unit 162 still drags the first audio output unit 131 to slide on the slide track 161, so that the first audio output unit 131 is maintained in the upper portion (i.e., the second end 112) of the mobile phone 800 while the counterweight unit 162 is maintained in the lower portion (i.e., the first end 111) the mobile phone 800, so as to output an audio signal from a counterpart talker to the user via a handset.

Thus, with the combining configuration of the transmitting means 160 and the first audio output unit 131 according to the first implementing mode being adopted, it is possible to detect the working direction that the mobile phone is currently in by the direction sensor, switch the audio input unit close to the user's mouth to the working state to receive an audio signal uttered by the user, and always maintain the audio output unit in the upper portion in the direction of gravity by using the principle that an object having a large mass is heavier than an object having a small mass, so as to output an audio signal to the user via a handset.

Figure 10:
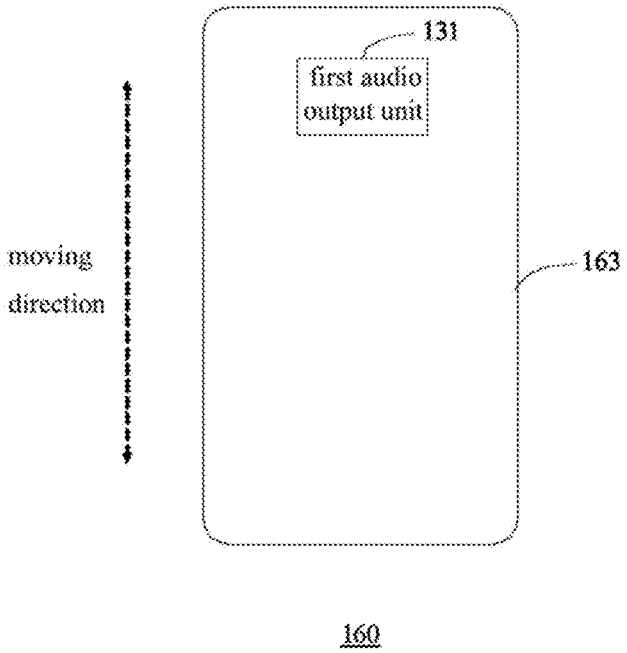
FIG. 10 illustrates a second implementing mode of the fourth example of the first embodiment according to the present invention.

FIG. 10 illustrates a second implementing mode of combining configuration of the transmitting means 160 and the first audio output unit 131 of the mobile phone 800 in the fourth example of the first embodiment according to the present invention.

As shown in FIG. 10, the transmitting means 160 according to the second implementing mode includes: a containing medium 163 provided within the transmitting means 160 and containing the first audio output unit 131 therein, and in the containing medium 163, the buoyancy on first audio output unit 131 is greater than the gravity it has.

In the second implementing mode, the containing medium 163 may be gases, liquids, etc. that have a buoyancy. In addition, the first audio output unit 131 may be a ordinary handset floating in the containing medium 163 so as to move within the containing medium 163, and, for example, the specific weight of the first audio output unit 131 is less than that of the containing medium 163.

As described in the first embodiment, when the user is in a standing state, he/she is usually using a mobile phone in a situation that the direction from the first end to the second end of the mobile phone is the direction of gravity. In this situation, when the gravity sensor 140 finds out that the user is using the mobile phone 800 in the direction of gravity, the switching unit 150 switches the first audio input unit 121 located in a lower portion of the mobile phone 800 to a working state, so as to receive voice uttered by the user. Meanwhile, since the buoyancy on the first audio output unit 131 is greater than the gravity it has, the first audio output unit 131 floats upwardly in the containing medium 163, so that the first audio output unit 131 is maintained at an upper portion (i.e., the first end 111) of the mobile phone 800 to output an audio signal from a counterpart talker to the user via a handset.

Contrarily, when the gravity sensor 140 finds out that the user is using the mobile phone 800 in a direction opposite to the direction of gravity, the switching unit 150 switches the second audio input unit 122 in the lower portion of the mobile phone 800 to the working state, so as to receive voice uttered by the user. Meanwhile, the first audio output unit 131 floats upwardly in the containing medium 163, so that the first audio output unit 131 is maintained in the upper portion (i.e., the second end 112) of the mobile phone 800, so as to output an audio signal from a counterpart talker to the user via a handset.

Thus, with the combining configuration of the transmitting means 160 and the first audio output unit 131 according to the second implementing mode being adopted, it is possible to detect the working direction that the mobile phone is currently in by the direction sensor, switch the audio input unit close to the user's mouth to the working state to receive an audio signal uttered by the user, and always maintain the audio output unit in the upper portion in the direction of gravity by using the balance principle between buoyancy and gravity, so as to output an audio signal to the user via a handset.

Figure 11:
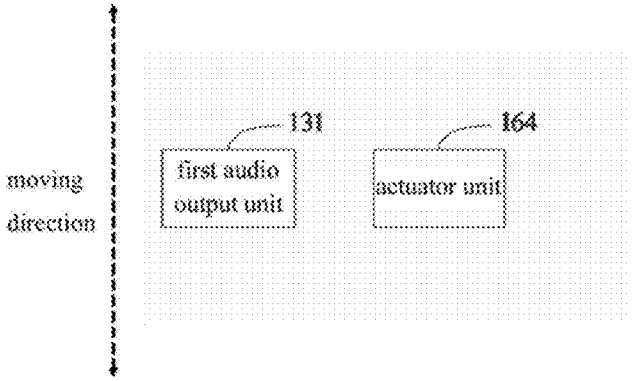
FIG. 11 illustrates a third implementing mode of the fourth example of the first embodiment according to the present invention.

FIG. 11 illustrates a third implementing mode of combining configuration of the transmitting means 160 and the first audio output unit 131 of the mobile phone 800 in the fourth example of the first embodiment according to the present invention.

As shown in FIG. 11, the transmitting means 160 according to the third implementing mode includes: an actuator unit 164 provided within the transmitting means 160 and mechanically connected with the first audio output unit 131.

In the third implementing mode, the actuator unit 164 may be a motor, and the motor for example has a mechanical lever connected to the top or bottom of the first audio output unit 131 to extent or contract the mechanical lever, so as to transmit the first audio output unit 131 to the first end 111 or the second end 112 of the mobile phone 800 along the same or different tracks. Alternatively, the mechanical lever may also be connected with a side of the first audio output unit 131 to lift up or push down the first audio output unit 131 to the first end 111 or the second end 112 of the mobile phone 800 in a manner of pivoting.

Same as or different from the situation described in the first embodiment, the user may use the mobile phone in a standing state (parallel to the direction of gravity), a lying state (vertical to the direction of gravity), or an inclined state (having an angle less than 90 degrees with the direction of gravity). In either situation, when the direction detecting means 140 (such as the holding gesture detecting unit or the intensity comparing unit etc.) determines that the first end 111 is located in a direction towards the user's head top and the second end 112 is located in a direction towards the user's jaw, the switching unit 150 switches the first audio input unit 121 located at the second end 112 of the mobile phone 800 to a working state, so as to receive voice uttered by the user. Meanwhile, the actuator unit 164 transmits the first audio output unit 131 to the first end 111 of the mobile phone 800, so as to output an audio signal from a counterpart talker to the user via a handset.

Contrarily, when the direction detecting means 140 determines that the first end 111 is located in the direction towards the user's jaw and the second end 112 is located in the direction towards the user's head top, the switching unit 150 switches the second audio input unit 122 at the first end 111 of the mobile phone 800 to the working state, so as to receive voice uttered by the user. Meanwhile, the actuator unit 164 transmits the first audio output unit 131 to the second end 112 of the mobile phone 800, so as to output an audio signal from a counterpart talker to the user via a handset.

Thus, with the combining configuration of the transmitting means 160 and the first audio output unit 131 according to the third implementing mode being adopted, it is possible to detect the working direction that the mobile phone is currently in by the direction sensor, switch the audio input unit close to the user's mouth to the working state so as to receive an audio signal uttered by the user, and always maintain the audio output unit in the upper portion in the direction of gravity by the mechanical push-pull principle so as to output an audio signal to the user via a handset.

Hereinafter, an electronic device and a direction switching method thereof according to a second embodiment of the present invention are to be described with reference to FIGS. 12 and 13.

Figure 12:
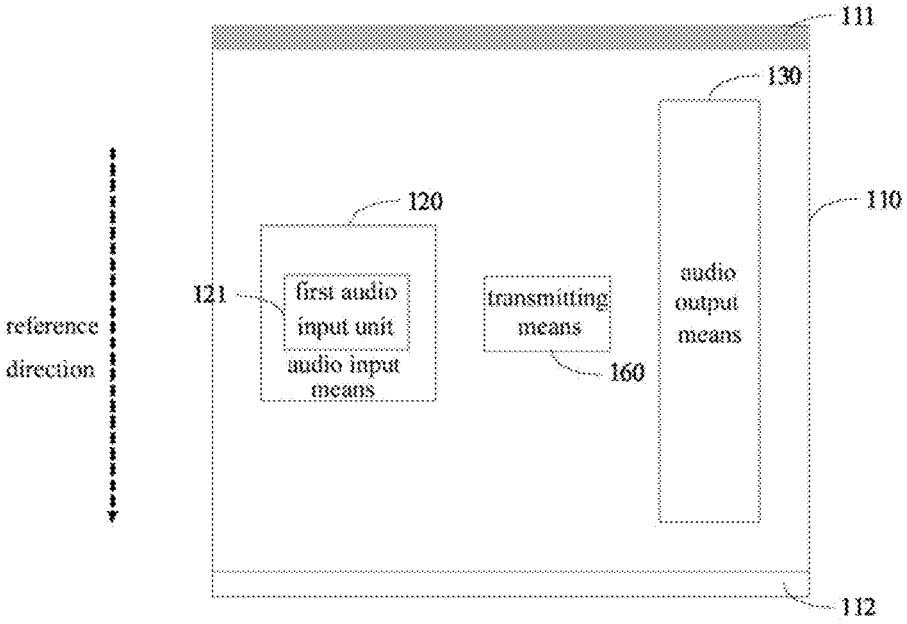
FIG. 12 illustrates an electronic device in a first working direction according to a second embodiment of the present invention.

FIG. 12 illustrates an electronic device in a first working direction according to the second embodiment of the present invention.

As shown in FIG. 12, same as the first embodiment, the electronic device according to the second embodiment of the present invention is, for example, a mobile phone 1200, which comprises: a housing 110 having a first end 111 and a second end 112; an audio output means 130, provided within the housing 110, used for outputting second audio information, and including at least one audio output unit. The mobile telephone 1200 has a first working direction and a second direction of work.

Different from the first embodiment, the mobile telephone 1200 comprises: an audio input unit 120, provided within the housing 110, used for inputting first audio information, and including a first audio input unit 121.

In addition, the mobile phone 1200 further comprises: a transmitting means 160, which is provided within the housing 110, and is used to transmit the first audio input unit 121 to the second end 112 when the mobile telephone 1200 is in the first working direction; and transmit the first audio input unit 121 to the first end 111 when the mobile telephone 1200 is in the second working direction. The transmitting means 160, for example, includes, but not limited to: a sliding rail, a containing medium, and an actuator unit.

Thus it can be seen that, with the mobile phone and the direction switching method of the mobile phone according to the second embodiment of the present invention being adopted, it is possible to switch the audio input unit to a working state and transmit the audio input unit to the second end when the mobile telephone is currently in the first working direction; and transmit the audio input unit in the working state to the first end of the mobile phone when the mobile telephone is currently in the second working direction, so that the user's mouth can always be aligned with the audio input unit, so as to receive an audio signal uttered by the user. Therefore, the second embodiment of the present invention can enable the user to dial a call without observing the location of the microphone.

Hereinafter, mobile telephones according to the respective examples of the second embodiment of the present invention are to be described with reference to FIG. 13 to FIG. 16.

Figure 13:
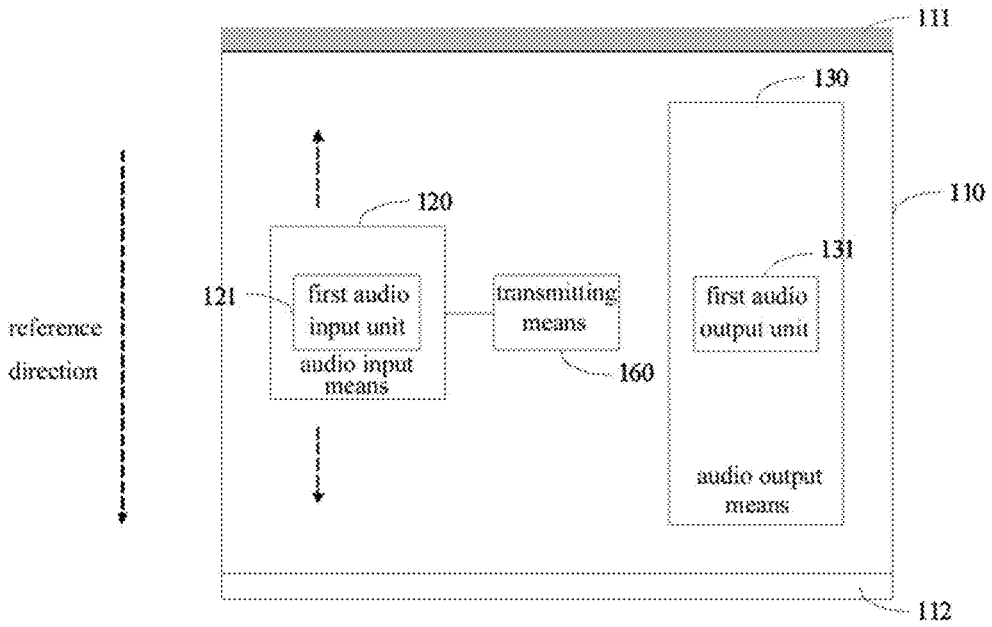
FIG. 13 illustrates a mobile telephone in a first example of the second embodiment according to the present invention.

FIG. 13 illustrates a mobile phone 1300 in a first example of the second embodiment according to the present invention.

Similar to the mobile phone of the second embodiment according to the present invention as shown in FIG. 12, as shown in FIG. 13, the mobile phone 1300 in the first example of the second embodiment according to the present invention also comprises: a housing 110, a first audio input unit 121, an audio output means 130, and a transmitting means 160, wherein, in particular, the audio output means 130 includes a first audio output unit 131 for outputting the second audio information in a first volume.

In the first example of the second embodiment, the first audio output unit 131 may be a loudspeaker located in any position of the mobile telephone 1300. In addition, the transmitting means 160 may include a sliding track set in its interior. As described in the first implementing mode of the fourth example of the first embodiment according to the present invention, the sliding track 161 may be a chain, a hinge, a slide rail, etc. that slides freely. In addition, the first audio input unit 121 may be a microphone fixedly installed (e.g., welding, riveting, paste, etc.) on the slide track and moving along the slide track.

As described in the first embodiment, when the user is in a standing state, he/she is usually using a mobile phone in a situation that the direction from the first end to the second end of the mobile phone is the direction of gravity. In this situation, when the user is using the mobile phone 1300 in the direction of gravity, since the first audio input unit 121 has a mass, the first audio output unit 131 drags itself to slide on the slide track 161 down to the direction of gravity, such that the first audio input unit 121 is maintained in a lower portion (i.e., the second end 112) of the mobile phone 1300. Contrarily, when the user is using the mobile phone 1300 in the direction opposite to the direction of gravity, the first audio output unit 131 drags itself to slide on the slide track 161 down to the lower portion in the direction of gravity, so that the first audio input unit 121 is maintained in the lower portion (i.e., the first end 111) of the mobile phone 1300.

Meanwhile, no matter whether the direction from the first end to the second end of the mobile phone is the direction of gravity, the first audio output unit 131 is always maintained in a working state, for outputting a voice signal of a counterpart talker received by the mobile phone from a base station in a manner of loudspeaking (in a high volume).

Thus, with the mobile phone in the first example of the second embodiment according to the present invention being adopted, it is possible to always maintain the audio input unit in the lower portion in the direction of gravity using the gravity principle so as to receive an audio signal uttered by the user, and always maintain the loudspeaker in the working state, to output a voice signal to the user in the manner of loudspeaking (in the high volume), without requiring a direction sensor to detect the working direction that the mobile phone is currently in.

Figure 14:
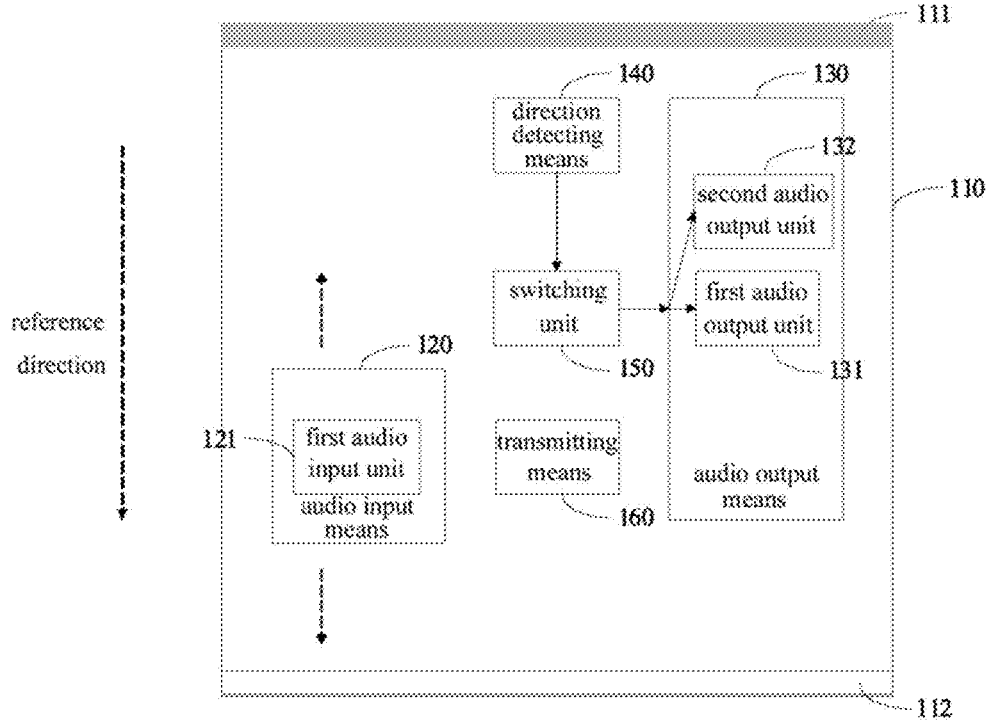
FIG. 14 illustrates a mobile telephone in a second example of the second embodiment according to the present invention.

FIG. 14 illustrates a mobile phone 1400 in a second example of the second embodiment according to the present invention.

Similar to the mobile phone of the second embodiment according to the present invention as shown in FIG. 12, as shown in FIG. 14, the mobile phone 1400 in the second example of the second embodiment according to the present invention also comprises: a housing 110, a first audio input unit 121, an audio output means 130, and a transmitting means 160, wherein, in particular, the audio output means 130 includes a first audio output unit 131 and a second audio output unit 132. The first audio output unit 131 is for outputting the second audio information in a first volume when it is in a working state; and the second audio output unit is located at the first end 111, and is for outputting the second audio information in a second volume when it is in the working state.

In addition, the mobile telephone 1400 further comprises: a direction detecting means 140 and a switching unit 150.

In the second example of the second embodiment, the first audio input unit 121 is maintained in the vicinity of the user's mouth by the transmitting means 160. It is detected by the direction detecting means 140 whether the mobile phone 1400 is in a first working direction or in a second working direction. The switching unit 150 switches the first audio output unit to a non-working state and switches the second audio output unit to a working state for outputting the second audio information when the direction detecting means 140 detects that the mobile phone 1400 is in the first working direction; and switches the second audio output unit to the non-working state, and switches the first audio output unit to the working state for outputting the second audio information when the direction detecting means detects that the mobile telephone 1400 is in the second working direction.

Thus, with the mobile phone in the second example of the second embodiment according to the present invention being adopted, it is possible to always maintain the audio input unit in a lower portion (i.e., close to the user's mouth) in the direction of gravity to receive an audio signal uttered by the user, detect the working direction that the mobile telephone is currently in by the direction detecting unit, and switch the audio output unit close to the user's ear or a loudspeaker to the working state to output an audio signal to the user via a handset or in a manner of loudspeaking.

Figure 15:
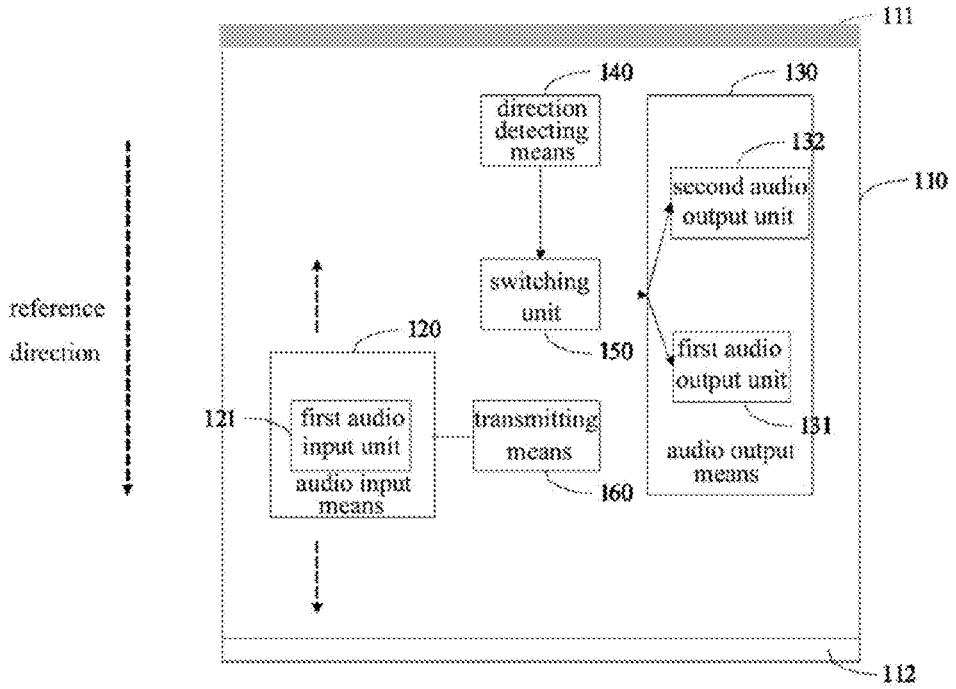
FIG. 15 illustrates a mobile telephone in a third example of the second embodiment according to the present invention.

FIG. 15 illustrates a mobile phone 1500 in a third example of the second embodiment according to the present invention.

Similar to the mobile phone of the second embodiment according to the present invention as shown in FIG. 12, as shown in FIG. 15, the mobile phone 1500 in the third example of the second embodiment according to the present invention also comprises: a housing 110, a first audio input unit 121, an audio output means 130, and a transmitting means 160, wherein, in particular, the audio output means 130 includes a first audio output unit 131 and a second audio output unit 132. The first audio output unit 131 is located at the second end 112 and for outputting the second audio information in a second volume when it is in a working state; and the second audio output unit is located at the first end 111, and is for outputting the second audio information in a second volume when it is in the working state.

In addition, the mobile phone 1500 further comprises: a direction detecting means 140 and a switching unit 150.

In the third example of the second embodiment, the first audio input unit 121 is maintained in the vicinity of the user's mouth by the transmitting means 160. It is detected by the direction detecting means 140 whether the mobile phone 1500 is in a first working direction or in a second working direction. The switching unit 150 switches the first audio output unit to a non-working state and switches the second audio output unit to a working state for outputting the second audio information when the direction detecting means 140 detects that the mobile phone 1500 is in the first working direction; and switches the second audio output unit to the non-working state and switches the first audio output unit to the working state for outputting the second audio information when the direction detecting means detects that the mobile telephone 1500 is in the second working direction.

Thus, with the mobile phone in the third example of the second embodiment according to the present invention being adopted, it is possible to always maintain the audio input unit in a lower portion (i.e., close to the user's mouth) in the direction of gravity to receive an audio signal uttered by the user, detect the working direction that the mobile telephone is currently in by the direction detecting unit, and switch the audio output unit close to the user's ear to the working state to output an audio signal to the user via a handset.

Figure 16:
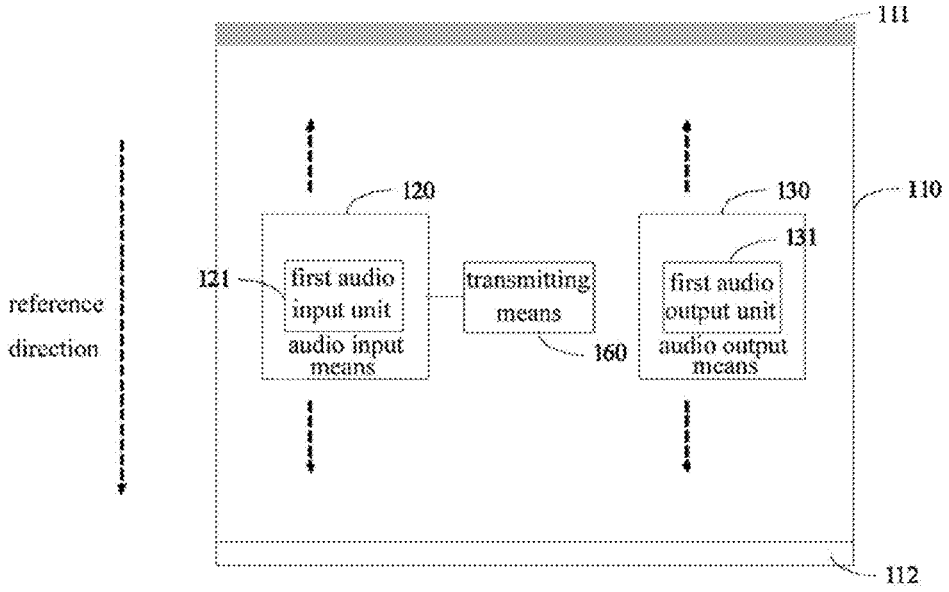
FIG. 16 illustrates a mobile telephone in a fourth example of the second embodiment according to the present invention.

FIG. 16 illustrates a mobile phone 1600 in a fourth example of the second embodiment according to the present invention.

Similar to the mobile phone of the second embodiment according to the present invention as shown in FIG. 12, as shown in FIG. 16, the mobile phone 1600 in the fourth example of the second embodiment according to the present invention also comprises: a housing 110, a first audio input unit 121, an audio output means 130, and a transmitting means 160, wherein, in particular, the audio output means 130 includes a first audio output unit 131. The first audio output unit 131 is for outputting the second audio information in a second volume. In addition, the transmitting means 160 is further for transmitting the first audio output unit to the first end when the mobile phone 1600 is in a first working direction; and transmitting the first audio output unit to the second end when the mobile phone 1600 is a second working direction.

Hereinafter, three implementing modes of combining configuration of the transmitting means 160 and the first audio output unit 131 of the mobile phone 1600 in the fourth example of the second embodiment according to the present invention are to be described with reference to FIGS. 17 to 19.

Figure 17:
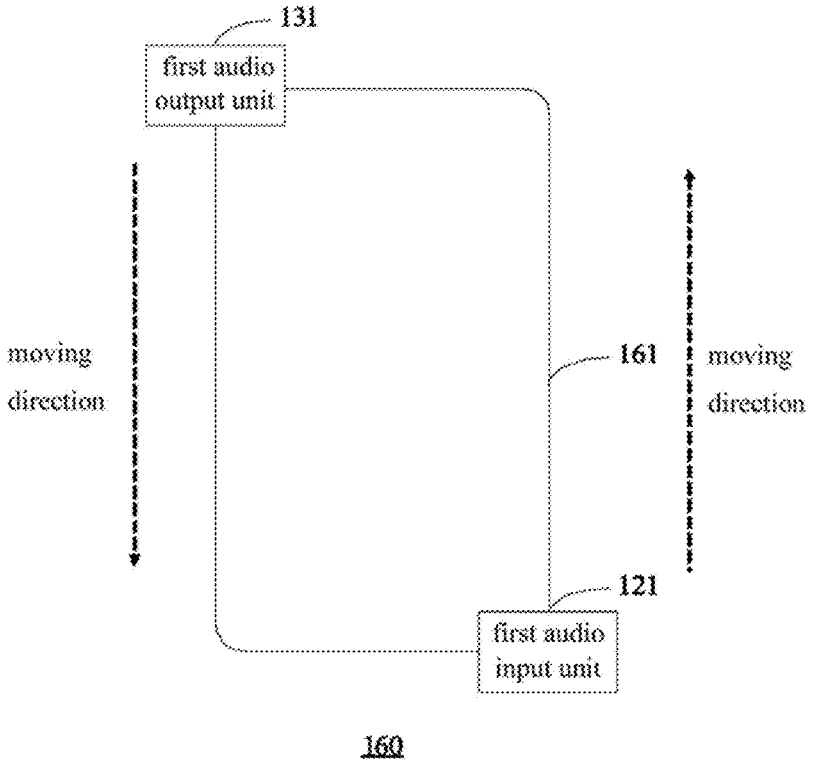
FIG. 17 illustrates a first implementing mode of the fourth example of the second embodiment according to the present invention.

FIG. 17 illustrates a first implementing mode of combining configuration of the transmitting means 160 and the first audio input unit 121 and the first audio output unit 131 of the mobile phone 1600 in the fourth example of the second embodiment according to the present invention.

As shown in FIG. 17, the transmitting means 160 according to the first implementing mode includes: a slide track 161, which is provided within the transmitting means 160 and on which the first audio input unit 121 and the first audio output unit 131 are installed. And the mass of the first audio input unit is greater than that of the first audio output unit.

As described in the first embodiment, when the user is in a standing state, he/she is usually using a mobile phone in a situation that the direction from the first end to the second end of the mobile phone is the direction of gravity. In this situation, when the user is using the mobile phone 1600 in the direction of gravity, since the mass of the first audio input unit is greater than that of the first audio output unit, the first audio input unit 121 drags the first audio output unit 131 to slide on the slide track 161, so that the first audio output unit 131 is maintained in an upper portion (i.e., the first end 111) of the mobile phone 1600 while the first audio input unit 121 is maintained in a lower portion (i.e., the second end 112) of the mobile telephone 1600.

Contrarily, when the user is using the mobile phone 1600 in a direction opposite to the direction of gravity, the first audio input unit 121 drags the first audio output unit 131 to slide on the slide track 161, so that still the first audio output unit 131 is maintained in the upper portion (i.e., the first end 111) of the mobile phone 1600 while the first audio input unit 121 is maintained in the lower portion (i.e., the second end 112) of the mobile telephone 1600.

Thus, with the combining configuration of the transmitting means 160 and the first audio input unit 121 and the first audio output unit 131 according to the first implementing mode, it is possible to maintain the first audio output unit in the upper portion in the direction of gravity while maintaining the first audio input unit 121 in the lower portion in the direction of gravity by using the principle that an object having a large mass is heavier than an object having a small mass, so as to output an audio signal to the user via a handset.

Figure 18:
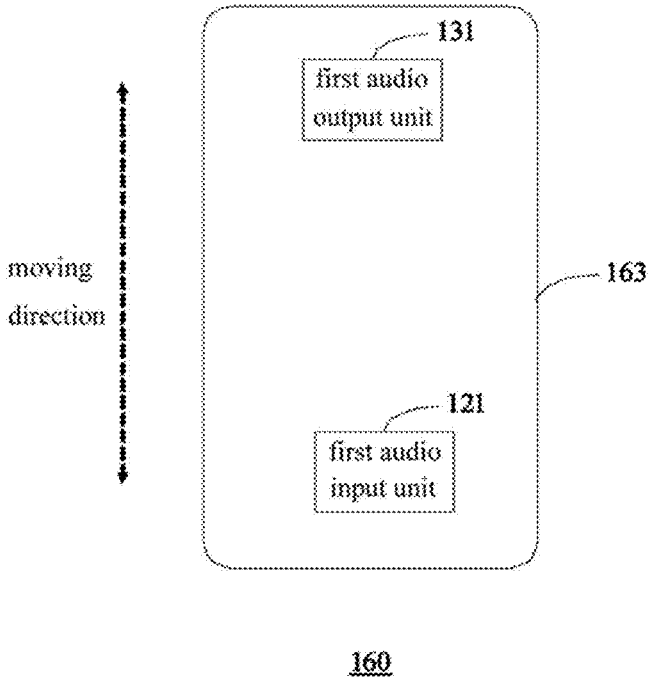
FIG. 18 illustrates a second implementing mode of the fourth example of the second embodiment according to the present invention.

FIG. 18 illustrates a second implementing mode of combining configuration of the transmitting means 160 and the first audio input unit 121 and the first audio output unit 131 of the mobile phone 1600 in the fourth example of the second embodiment according to the present invention.

As shown in FIG. 18, the transmitting means 160 according to the second implementing mode includes: a containing medium 163 provided within the transmitting means 160 and containing the first audio input unit 121 and the first audio output unit 131 therein, and in the containing medium 163, the buoyancy on the first audio input unit 121 is smaller than the gravity it has and the buoyancy on the first audio output unit 131 is greater than the gravity it has. For example, the specific weight of the first audio input unit 121 is greater than that of the containing medium 163, and the specific weight of the first audio output unit 131 is less than that of the containing medium 163.

As described in the first embodiment, when the user is in a standing state, he/she is usually using a mobile phone in a situation that the direction from the first end to the second end of the mobile phone is the direction of gravity. In this situation, when the user is using the mobile phone 1600 in the direction of gravity, since in the containing medium 163, the buoyancy on the first audio input unit 121 is smaller than the gravity it has, and the buoyancy on the first audio output unit 131 is greater than the gravity it has, thus the first audio input unit 121 sinks downwardly in the receiving medium 163 and the first audio output unit 131 floats upwardly in the receiving medium 163, so that the first audio output unit 131 is maintained in an upper portion (i.e., the first end 111) of the mobile telephone 1600 while the first audio input unit 121 is maintained in a lower portion (i.e., the second end 112) of the mobile phone 1600.

Contrarily, when the user is using the mobile phone 1600 in a direction opposite to the direction of gravity, still the first audio output unit 131 is maintained in the upper portion (i.e., the first end 111) of the mobile telephone 1600 while the first audio input unit 121 is maintained in the lower portion (i.e., the second end 112) of the mobile phone 1600.

Thus, with the combining configuration of the transmitting means 160 and the first audio input unit 121 and the first audio output unit 131 according to the second implementing mode being adopted, it is possible to always maintain the audio output unit in the upper portion in the direction of gravity while always maintaining the audio input unit in the lower portion in the direction of gravity by using the balance principle between buoyancy and gravity.

Figure 19:
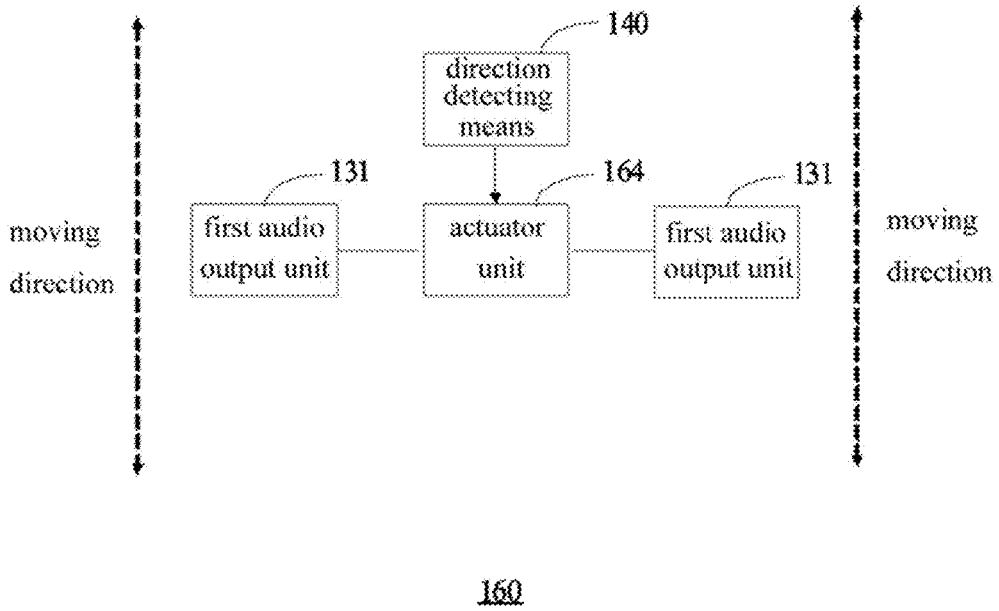
FIG. 19 illustrates a third implementing mode of the fourth example of the second embodiment according to the present invention.

FIG. 19 illustrates a third implementing mode of combining configuration of the transmitting means 160 and the first audio input unit 121 and the first audio output unit 131 of the mobile phone in the fourth example of the second embodiment according to the present invention.

As shown in FIG. 19, in the third implementing mode, the mobile phone further comprises: a direction detecting means for detecting whether the mobile phone 1600 is in a first working direction or in a second working direction. Furthermore, the transmitting means 160 according to the third implementing mode includes: an actuator unit 164 provided within the transmitting means 160 and mechanically connected with the first audio input unit 121 and the first audio output unit 131.

Same as or different from the situation described in the first embodiment, the user can use the mobile phone in a standing state (parallel to the direction of gravity), a lying state (vertical to the direction of gravity), or an inclined state (having an angle less than 90 degrees with the direction of gravity). In either situation, when the direction detecting means 140 determines that the first end 111 is located in a direction towards the user's head top, and the second end 112 is located in a direction towards the user's jaw, the actuator unit 164 transmits the first audio output unit 131 to the first end 111 of the mobile phone 1600 along a second track while transmitting the first audio input unit 121 to the second end 112 of the mobile phone 1600 along a first track, and the first track and the second track may be the same track or different tracks.

Contrarily, when the direction detecting means 140 determines that the first end 111 is located in the direction towards the user's jaw, and the second end 112 is located in the direction towards the user's head top, the actuator unit 164 transmits the first audio output unit 131 to the second end 112 of the mobile phone 1600 while transmitting the first audio input unit 121 to the first end 111 of the mobile telephone 1600.

Thus, with the combining configuration of the transmitting means 160 and the first audio input unit and the first audio output unit 131 according to the third implementing mode being adopted, it is possible to always maintain the audio output unit in the upper portion in the direction of gravity while always maintaining the audio input unit in the lower portion in the direction of gravity by the mechanical push-pull principle.

It should be noted that, although herein explanation is made by applying the various component means, such as the direction detecting means and the transmitting means and the like, to the specific example of the specific embodiment of the present invention, one of skill in the art can understand that, the present invention is not limited thereto. Various component means may be also alternatively used in any embodiment, any example, or any implementing mode of the present invention.

Further, although herein the present invention is explained by setting the audio input unit and the audio output unit at the upper end and the lower end of the electronic device respectively, one of skill in the art can understand that the present invention is not limited thereto. The audio input unit and the audio output unit may be also set at four ends (i.e., the upper end, the lower end, the left end, and the right end) of the electronic device, and the display interface of the electronic device may be dynamically adjusted by detecting the direction that the user holds the electronic device, so as to enable the user to use the electronic device in any way without checking the direction of the electronic device, which thereby completely solves the directionality problem of the electronic device, and achieves an omni-directionally symmetric electronic device.

In addition, the following embodiments of the present invention disclose an information processing method, an information processing means, and an electronic device. The specific structure and process of information processing are to be described in detail by the following embodiments.

Third Embodiment

Figure 20:
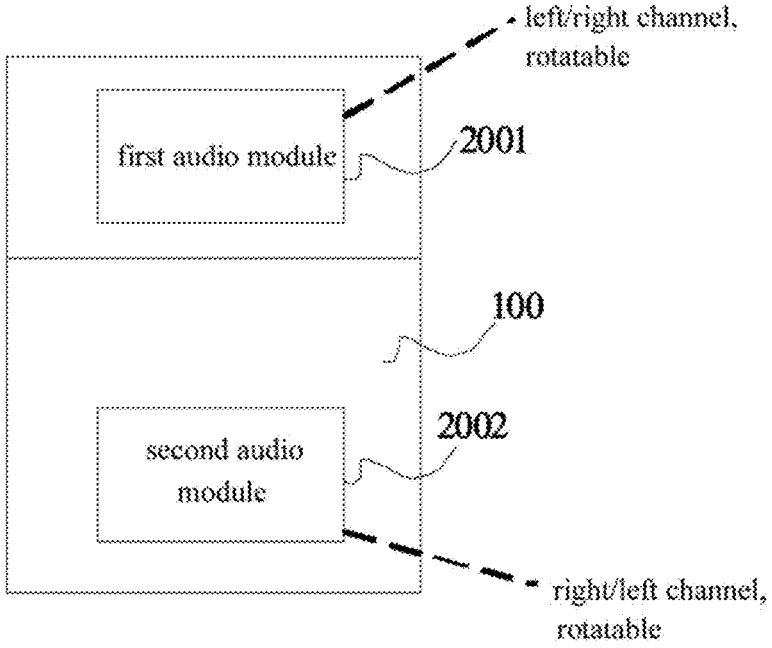
FIG. 20 is a schematic diagram of the structure of an electronic device disclosed in a third embodiment of the present invention.

As shown in FIG. 20 which is a schematic diagram of the structure of an electronic device disclosed in the third embodiment of the present invention, the electronic device 100 at least comprises a first audio module 2001 and a second audio module 2002.

For example, as shown in FIG. 1, the audio input means 120 in the electronic device 100 includes the first audio module 2001 as a first audio input unit located at the second end; and the audio output means 130 in the electronic device 100 includes the second audio module 2002 as a first audio output unit located at the first end.

Wherein, the first audio module 2001 is capable of receiving an electrical signal and converting the received electrical signal to a sound signal to play, and also receiving a sound signal and converting the sound signal to an electrical signal.

The second audio module 2002 is capable of receiving an electrical signal and converting the received electrical signal to a sound signal to play, and also receiving a sound signal and converting the sound signal to an electrical signal.

Figure 21:
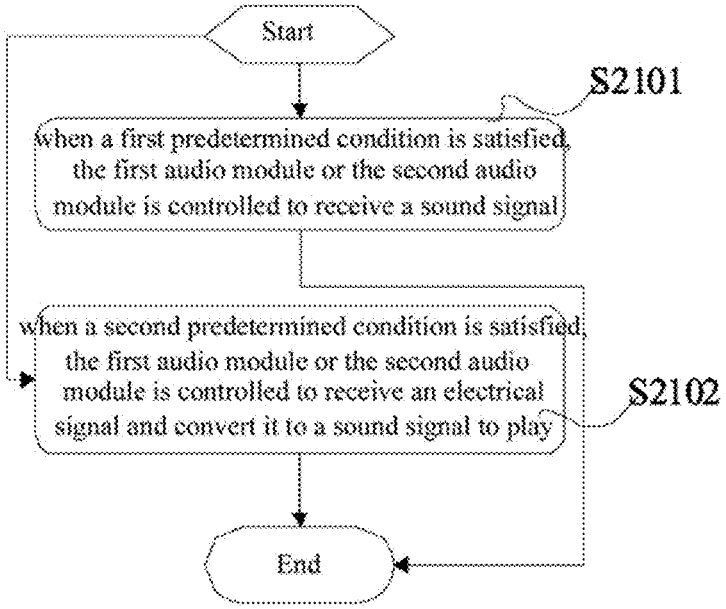
FIG. 21 is a flowchart of an information processing method disclosed in the third embodiment of the invention.

Based on the above electronic device disclosed in the third embodiment of the present invention, as shown in FIG. 21, the procedures of processing various types of information, that is, the steps of causing the audio input unit in a working state to be at the second end when the electronic device is in the first working direction and causing the audio input unit in the working state to be at the first end when the electronic device is in the second working direction as shown in FIG. 2, mainly include the following steps:

Step S2101, the first audio module or the second audio module is controlled to receive a sound signal when the electronic device satisfies a first predetermined condition, wherein the first predetermined condition is: to enable a voice call application through a virtual or physical key;

Step S2102, the first audio module or the second audio module is controlled to receive an electrical signal and convert it to a sound signal to play when the electronic device satisfies a second predetermined condition, wherein the second predetermined condition is: to enable an audio play application through a virtual or physical key.

When, in step S2101, the electronic device satisfies a first predetermined condition, the first audio module receives a sound signal; and when the electronic device satisfies a second predetermined condition, the first audio module receives an electronic signal when enabling an audio play application through a virtual or physical key, and converts the electrical signal to a sound signal to play. At this time, the second audio module, which is originally applied to play a sound signal when enabling an audio play application, simultaneously plays the sound signal, thus achieving stereo playing.

Accordingly, when, in step S2101, the electronic device satisfies a first predetermined condition, the second audio module receives a sound signal; and when the electronic device satisfies a second predetermined condition, the second audio module receives an electronic signal when enabling an audio play application through a virtual or physical key, and converts the electrical signal to a sound signal to play. At this time, the first audio module, which is originally applied to play a sound signal when enabling an audio play application, simultaneously plays the sound signal, thus achieving stereo playing.

It should be noted that, based on FIG. 20, in the process of carrying out the above play, when the first audio module 2001 corresponds to a left channel, a sound outlet corresponding to the first audio module 2001 plays a sound signal in the left channel;

when the second audio module 2002 corresponds to a right channel, a sound outlet corresponding to the second audio module 2002 plays a sound signal in the right channel;

alternatively, when the first audio module 2001 corresponds to a right channel, a sound outlet corresponding to the first audio module 2001 plays a sound signal in the right channel;

when the second audio module 2002 corresponds to a left channel, a sound outlet corresponding to the second audio module 2002 plays a sound signal in the left channel.

Through the above information processing process, the third embodiment of the present invention plays audio for the electronic device having at least a first audio module and a second audio module, and the third embodiment of present invention also discloses specific examples in actual application to make detailed explanation.

First Example

Figure 22:
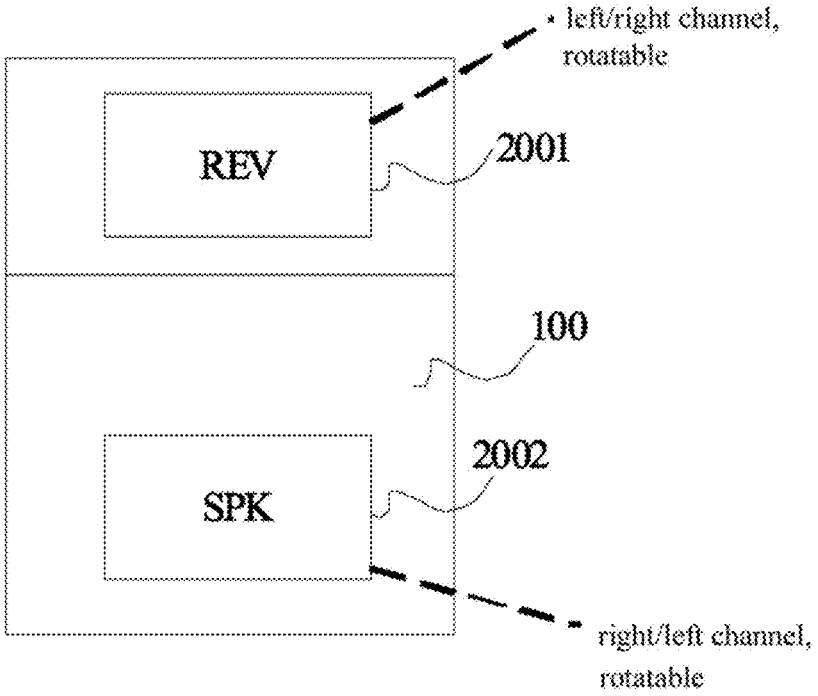
FIG. 22 is a schematic diagram of the structure of an electronic device in a first example disclosed in the third embodiment of the present invention.

As shown in FIG. 22, the first audio module 2001 corresponds to REV (handset (receiver)), and the second audio module 2002 corresponds to SPK (loudspeaker or megaphone (speaker)).

When satisfying a first predetermined condition and enabling a voice call application through a virtual or physical key, the REV will receive a sound signal.

When satisfying a second predetermined condition and enabling an audio play application through a virtual or physical key, the REV is controlled to receive an electrical signal when enabling an audio play application, and convert the electrical signal to a corresponding sound signal to play.

Meanwhile, the SPK, as the audio player, receives an electrical signal when enabling an audio play application, and converts the electrical signal to a corresponding sound signal to play.

Thus, when satisfying a second predetermined condition, the SPK corresponding to the first audio module 2001 and the REV corresponding to the second audio module 2002 play sound signals synchronously.

It should be noted that, in a specific process of playing audio, the above information control method disclosed in the third embodiment of the present invention can be adopted to cause the first audio module 2001 and the second audio module 2002 to correspond to the left and right channels respectively, and play separately.

Through the explanation of the above specific application, the third embodiment of the present invention uses the electronic device having at least two audio modules, and on the basis of satisfying the predetermined conditions, causes both the first audio module and the second audio module to be capable of receiving electrical signals and converting them to sound signals to play. Stereo playing is achieved without increasing manufacturing cost to the electronic device. Internal space is further saved for the electronic device, so that the saved space can be used for other purposes.

Fourth Embodiment

Figure 23:
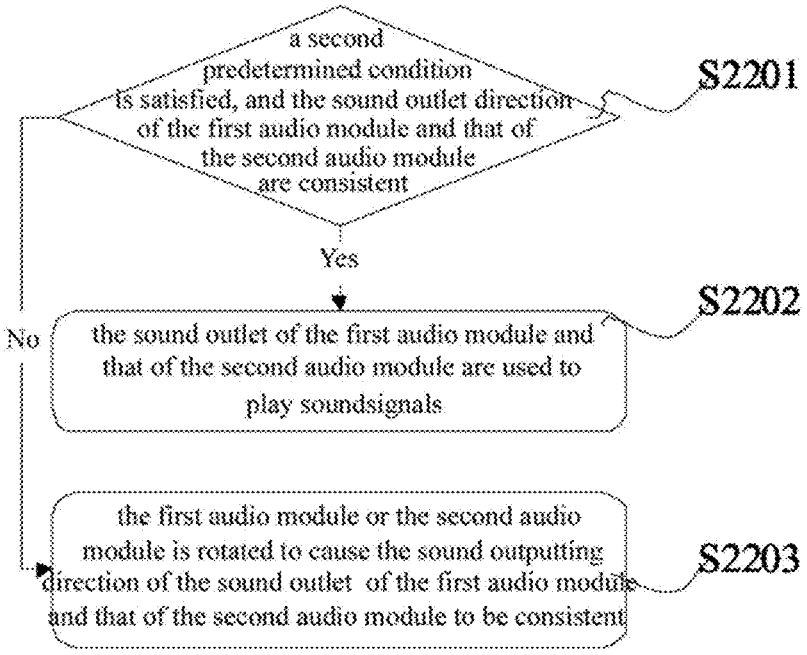
FIG. 23 is a flowchart of an information processing method disclosed in a fourth embodiment of the invention.

On the basis of the above-described electronic device disclosed in the third embodiment as shown in FIG. 20, the first audio module or the second audio module in the electronic device disclosed in the fourth embodiment of present invention can be rotated, and as shown in FIG. 23, a flowchart of rotation control over the first audio module or the second audio module mainly includes the following steps:

Step S2201, when the electronic device satisfies a second predetermined condition, it is determined whether the sound outlet directions of the first audio module and the second audio module that are currently playing sound signals are consistent, if consistent, step S2202 is executed; if not, step S2203 is executed.

Step S2202, the sound outlet of the first audio module and that of the second audio module are used to play sound signals.

Step S2203, the first audio module or the second audio module is rotated to cause the sound outputting direction of the sound outlet of the first audio module and that of the second audio module to be consistent.

Through the above rotation control method disclosed in the embodiment of the present invention, when, in the electronic device at least having a first audio module and a second audio module that can be rotated, the sound outlet direction of the first audio module and that of the second audio module are not consistent, with the mode of the fourth embodiment of the present invention being adopted, it is possible to control the sound outlet direction of the first audio module and that of the second audio module to be consistent, so that when audio signals are played synchronously in the first audio module and the second audio module, sound in the same direction is made more clear and loud, thus reflecting better stereo playing effect.

It should be noted that, based on FIG. 20, after causing the sound outlet direction of the first audio module 2001 and that of the second audio module 2002 to be consistent, during the process of the above-mentioned play, when the first audio module 2001 corresponds to a left channel, a sound outlet corresponding to the first audio module 2001 plays a sound signal in the left channel;

when the second audio module 2002 corresponds to a right channel, a sound outlet corresponding to the second audio module 2002 plays a sound signal in the right channel;

alternatively, when the first audio module 2001 corresponds to a right channel, a sound outlet corresponding to the first audio module 2001 plays a sound signal in the right channel;

when the second audio module 2002 corresponds to a left channel, a sound outlet corresponding to the second audio module 2002 plays a sound signal in the left channel.

Through the information processing procedures disclosed in the third and fourth embodiments of the present invention, audio is played for the electronic device at least having the first audio module and the second audio module that can be rotated. The fourth embodiment of the present invention further discloses specific examples in actual application for detailed explanation.

Second Example

Figure 24:
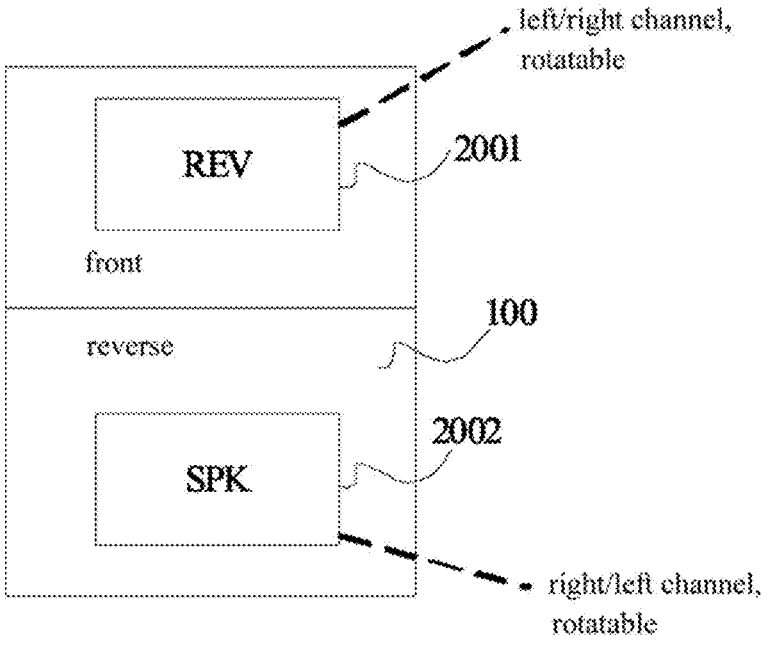
FIG. 24 is a schematic diagram of the structure of an electronic device according to a second example disclosed in the fourth embodiment of the present invention.

As shown in FIG. 24, when the electronic device is a mobile terminal, under normal circumstances, the mobile terminal has two audio modules, wherein the first audio module 2001 corresponds to REV, and the second audio module 2002 corresponds to SPK.

When the user enables a voice call application through a virtual or physical key, a sound signal is received by the REV.

When the user enables a voice play application through a virtual or physical key, it is determined whether a sound outlet direction of the REV and that of the SPK are consistent, if not consistent, the REV is controlled to rotate, so as to cause the sound outlet direction of the REV to be consistent with that of the SPK.

The REV is controlled to receive an electrical signal when enabling an audio play application, and convert the electrical signal to a corresponding sound signal to play.

Meanwhile, the SPK, as the audio player, receives an electrical signal when enabling an audio play application, and converts the electrical signal to a corresponding sound signal to play.

Thus, when a second predetermined condition is satisfied, the audio modules whose the sound outlet directions are different are adjusted to be in the same direction, so that the REV corresponding to the first audio module 2001 and the SPK corresponding to the second audio module 2002 can play audio signals in the same direction.

It should be noted that, in a specific process of playing audio, adopting the information control method disclosed in the third embodiment of the present invention causes the first audio module 2001 and the second audio module 2002 to correspond to the left and right channels respectively, and play separately.

In addition, during the process of rotating, in the second example disclosed in the fourth embodiment of the present invention, the REV is rotated with the sound outlet direction of the SPK taken as a reference direction. The present invention is not limited thereto. The sound outlet direction of the REV can also be taken as the reference direction to control the SPK to rotate, so long as it can be ensured that the REV corresponding to the first audio module 2001 and the SPK corresponding to the second audio module 2002 can play sound signals in the same direction.

Through the above explanation of the specific application, the fourth embodiment of the present invention employs the electronic device at least having two audio modules that can be rotated, and on the basis of satisfying the predetermined conditions, causes the first audio module and the second audio module to be both able to receive electrical signals, convert them to sound signals, and play in the same direction. Stereo playing is achieved without increasing manufacturing cost to the electronic device, and setting the first audio module and the second audio module in the same direction can reflect better stereo playing effect.

Further, internal space is saved for the electronic device, so that the saved space can be used for other purposes.

Fifth Embodiment

Figure 25:
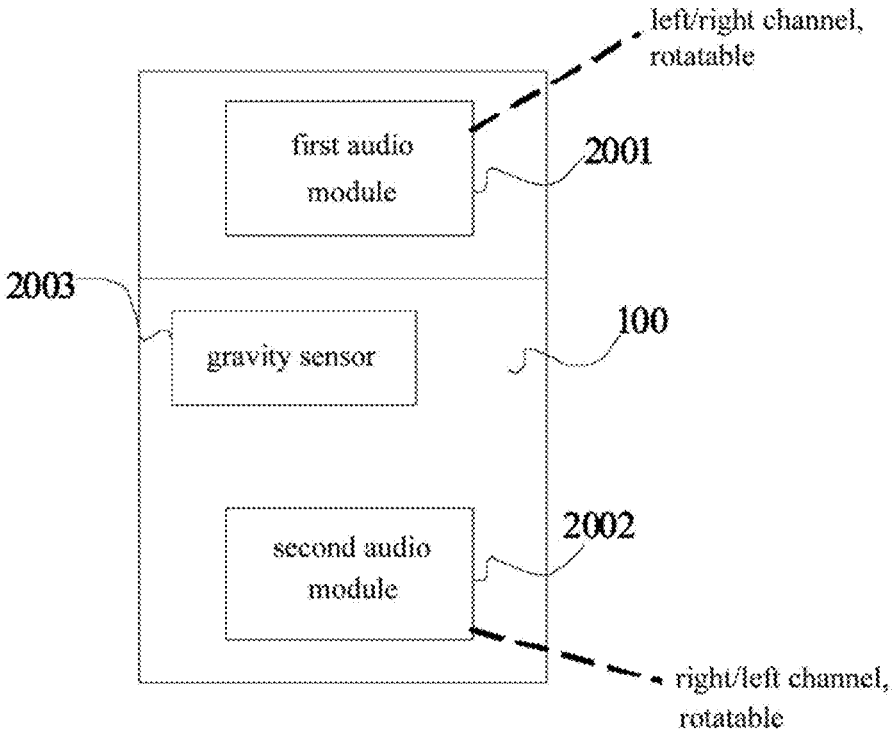
FIG. 25 is a schematic diagram of the structure of an electronic device disclosed in a fifth embodiment of the present invention.

On the basis of the above-described electronic devices disclosed in third and fourth embodiments, the electronic device disclosed in the fifth embodiment of the present invention, as shown in FIG. 25, further comprises: a gravity sensor 2003. Based on the information processing procedures executed in the above embodiments, the following examples are provided for detailed explanation.

Third Example

Figure 26:
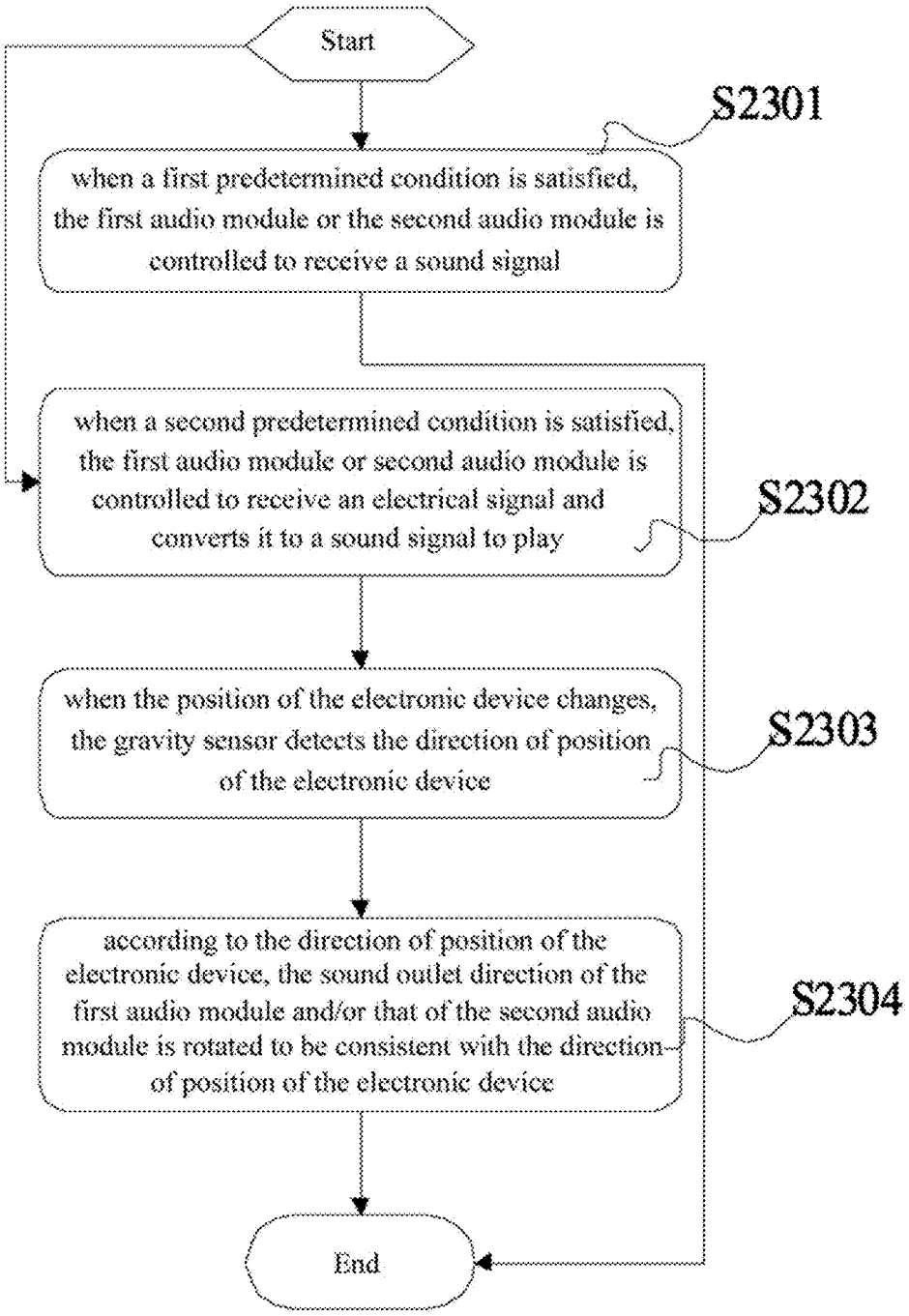
FIG. 26 is a flowchart of an information processing method disclosed in a third example disclosed in the fifth embodiment of the present invention.

Based on the information processing method of the electronic device disclosed in the third embodiment, as shown in FIG. 26, flow of the specific information processing method of the third example mainly comprises the following steps:

Step S2301, when the electronic device satisfies a first predetermined condition, the first audio module or the second audio module is controlled to receive a sound signal.

Step S2302, when the electronic device satisfies a second predetermined condition, the first audio module or second audio module is controlled to receive an electrical signal and converts it to a sound signal to play.

The above steps S2301 to S2302 are consistent with the step S2101 to S2102 disclosed in the third embodiment, no more details repeated herein.

Step S2303, when the position of the electronic device changes, the gravity sensor detects the direction of position of the electronic device.

When executing step S2303 to use the gravity sensor to detect the position of the electronic device, the detection takes a preset reference direction as a reference.

That is, when the front of the electronic device, i.e. the side that faces the user in a normal state, is a preset reference direction, after the electronic device is inverted to the opposite, the side that originally has its back to the user now faces the user, and current position information is detected by the gravity sensor.

With the process of detecting a current position of the electronic device by using the gravity detector according to the preset reference direction as described above, it is possible to finally determine whether the electronic device is in a front state or in a reverse state.

Step S2304, according to the direction of position of the electronic device as detected by the gravity sensor, the sound outlet direction of the first audio module and/or that of the second audio module is rotated, so as to cause the directions of the two sound outlets to be consistent with the direction of position of the electronic device.

Step S2304 is executed to rotate the sound outlet direction of the first audio module and that of the second audio module based on the current position of the electronic device as determined by step S2303. The details are as follows:

In the case that the sound outlet direction of the first audio module and that of the second audio module are the same, when the sound outlet directions of the two are opposed to the direction of position of the electronic device as currently detected, the sound outlets of the first audio module and the second audio module are rotated to cause the sound outlet directions of the two audio module to be the same as the direction of the current position of the electronic device; when the sound outlet directions of the two are the same as the direction of position of the electronic device as currently detected, there is no need to rotate, and the sound outlet directions are maintained.

In the case that the sound outlet direction of the first audio module and that of the second audio module are not the same, when the sound outlet direction of any of the two is opposed to the direction of position of the electronic device as currently detected, the sound outlet of one of the first audio module and the second audio module is rotated, and the sound outlet direction of the other audio module is maintained, so as to cause the sound outlet directions of the two audio modules to be same as the direction of the current position of the electronic device.

By detecting and controlling the audio modules and the current position of the electronic device in the above process of audio information or sound information playing, the sound outlet direction of the first audio module and/or that of the second audio module is made consistent with the direction of the current position of the electronic device, that is, ensuring that the direction of a sound outlet that plays sound information always faces the user, and the sound information is played without being blocked, thus enhancing stereo playing effect.

Meanwhile, the objective of stereo playing is achieved without increasing manufacturing cost to the electronic device.

Fourth Example

Figure 27:
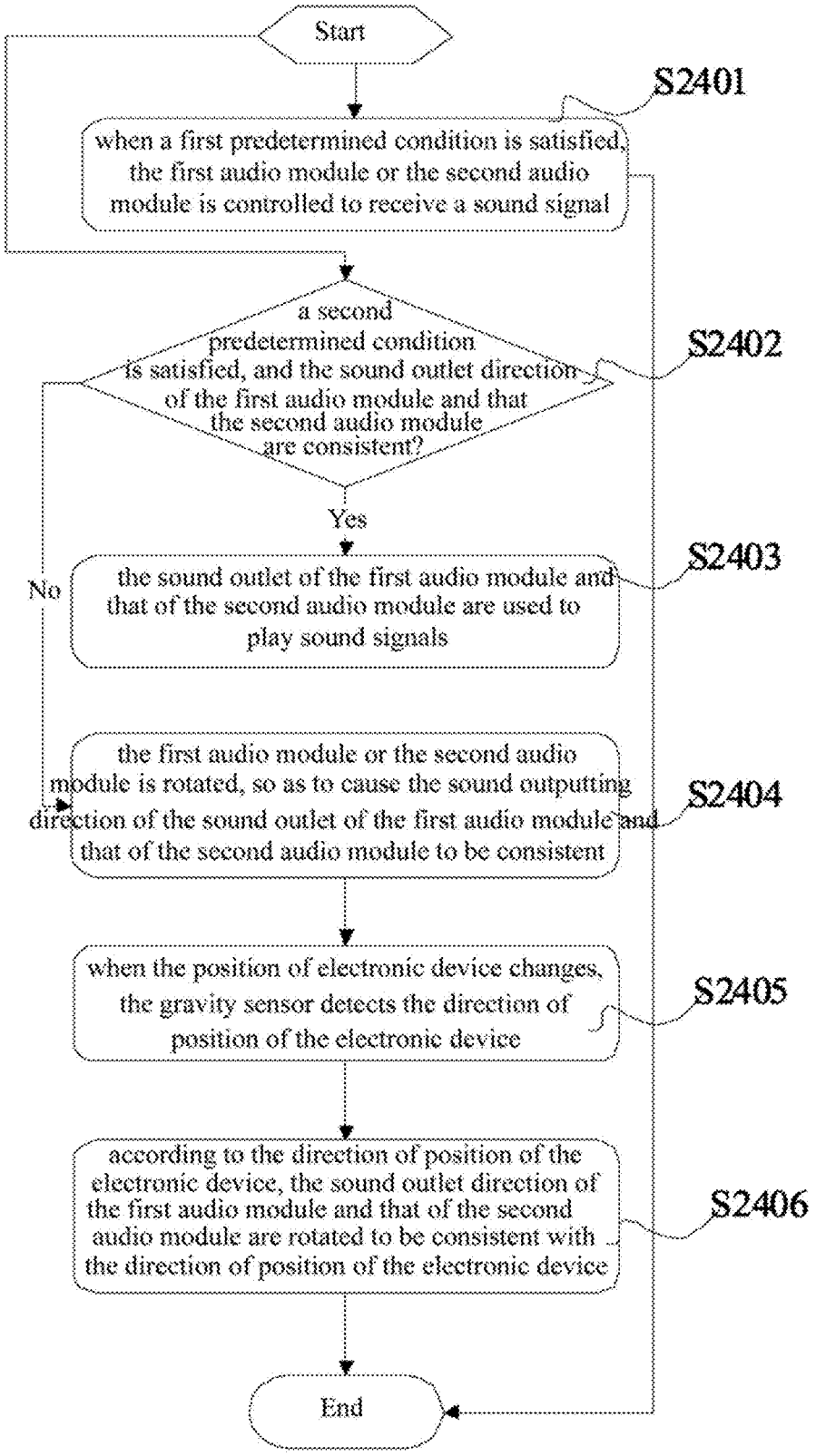
FIG. 27 is a flowchart of an information processing method disclosed in a fourth example disclosed in the fifth embodiment of the present invention.

Based on the information processing method of the electronic device disclosed in the third and fourth embodiments, as shown in FIG. 27, flow of the specific information processing method of the fourth example mainly includes the following steps:

Step S2401, when the electronic device satisfies a first predetermined condition, the first audio module or the second audio module is controlled to receive a sound signal.

Step S2402, when the electronic device satisfies a second predetermined condition, it is determined whether the sound outlet directions of the first audio module and the second audio module that are currently playing sound signals are consistent, if consistent, step S2403 is executed; if not, step S2404 is executed.

Step S2403, the sound outlet of the first audio module and that of the second audio module are used to play sound signals.

Step S2404, the first audio module or the second audio module is rotated, so as to cause the sound outputting direction of the sound outlet of the first audio module and that of the second audio module to be consistent.

The above steps S2401 to S2404 are substantially consistent with the steps S2101 to S2102 and steps S2201 to S2203 disclosed in the third and fourth embodiments, no more details repeated herein.

Step S2405, when the position of electronic device changes, the gravity sensor detects the direction of position of the electronic device.

Step S2406, according to the direction of position of the electronic device as detected the gravity sensor, the sound outlet direction of the first audio module and that of the second audio module are rotated, so as to cause the directions of the two sound outlets to be consistent with the direction of position of the electronic device.

The above steps S2405 to S2406 are substantially consistent with the steps S2303 to S2304 disclosed in the third example, no more details repeated herein. What is different is that, when a situation that needs rotation occurs, since step S2404 is already executed to cause the sound outlet direction of the first audio module and that of the second audio module to be the consistent, in the process of executing the step S2406, the sound outlet direction of the first audio module and that of the second audio module need to be rotated simultaneously to make them consistent with the direction of the current position of the electronic device.

Similarly, in the above process of audio or sound information playing, by detecting and controlling the audio modules and the current position of the electronic device, the sound outlet direction of the first audio module and/or that of the second audio module is made consistent with the direction of the current position of the electronic device, that is, ensuring that the direction of a sound outlet that plays sound information always faces the user, and the sound information is played without being blocked, thus enhancing stereo playing effect, while achieving the objective of stereo playing sound information without increasing manufacturing cost to the electronic device.

It should be noted that, as shown in FIG. 25, based on the third and fourth examples disclosed in the fifth embodiment of the present invention, after causing the sound outlet direction of the first audio module 2001 and that of the second audio module 2002 to be consistent with the direction of the current position of the electronic device, during the process of the above-mentioned playing, when the first audio module 2001 corresponds to a left channel, a sound outlet corresponding to the first audio module 2001 plays a sound signal in the left channel;

when the second audio module 2002 corresponds to a right channel, a sound outlet corresponding to the second audio module 2002 plays a sound signal in the right channel;

alternatively, when the first audio module 2001 corresponds to a right channel, a sound outlet corresponding to the first audio module 2001 plays a sound signal in the right channel;

when the second audio module 2002 corresponds to a left channel, a sound outlet corresponding to the second audio module 2002 plays a sound signal in the left channel.

By the contents disclosed in the above various embodiments of the present invention, with the left and right channels corresponding to the first audio module and the second audio module respectively being adopted, stereo playing effect is achieved and enhanced without increasing manufacturing cost to the electronic device. Further, internal space is saved for the electronic device, so that the saved space can be used for other purposes.

For the information processing method specifically described in the above third to fifth embodiments disclosed in the present invention, an embodiment of the present invention also discloses information processing means that correspondingly executes the above-described methods, and below provided is a specific embodiment for detailed explanation.

Sixth Embodiment

Figure 28:
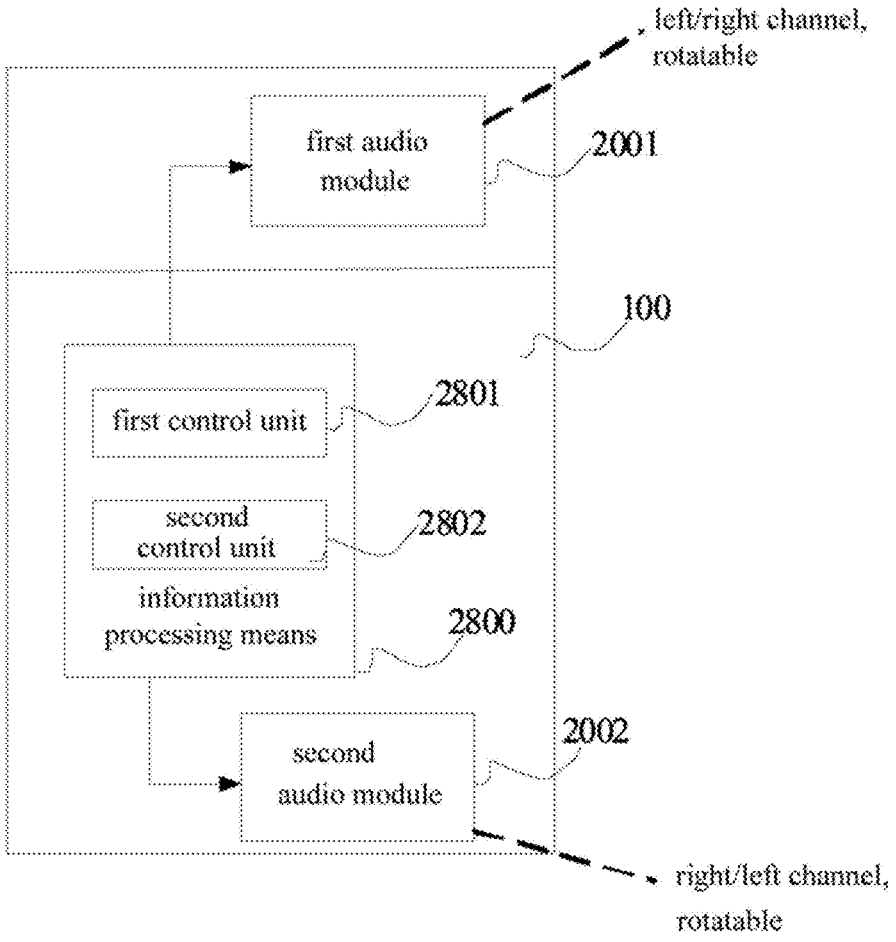
FIG. 28 is a schematic diagram of the structure of an information processing means applied to an electronic device disclosed in a sixth embodiment of the present invention.

As shown in FIG. 28 which is a schematic diagram of the structure of an information processing means disclosed in the sixth embodiment of the present invention, based on the information processing method disclosed in the third embodiment of the present invention embodiment, the information processing means 2800 is applied to the electronic device 100, and the electronic device 100 has at least a first audio module 2001 and a second audio module 2002.

For example, the information processing means 2800 may be integrated into the electronic device 100 as a software module and/or a hardware module. Alternatively, the information processing means 2800 may also be a separate device from the electronic device 100, and connected to the electronic device 100 via a wired and/or wireless network, so as to transmit interaction information in accordance with an agreed data format.

The information processing means 2800 mainly includes:

a first control unit 2801, for controlling the first audio module 2001 or the second audio module 2002 to receive the sound signal when the electronic device 100 satisfies a first predetermined condition;

a second control unit 2802, for controlling the first audio module 2001 or the second audio module 2002 to receive the electrical signal and converting it to the sound signal to play when the electronic device 100 satisfies a second predetermined condition, wherein the first audio module 2001 is capable of receiving an electrical signal and converting it to a sound signal to play, and also receiving a sound signal and converting it to an electric signal;

the second audio module 2002 is capable of receiving an electrical signal and converting it to a sound signal to play, and also receiving a sound signal and converting it to an electric signal.

The specific executing process of each of the above modules is the same as the content disclosed in the third embodiment of the present invention, no more details repeated herein.

Figure 29:
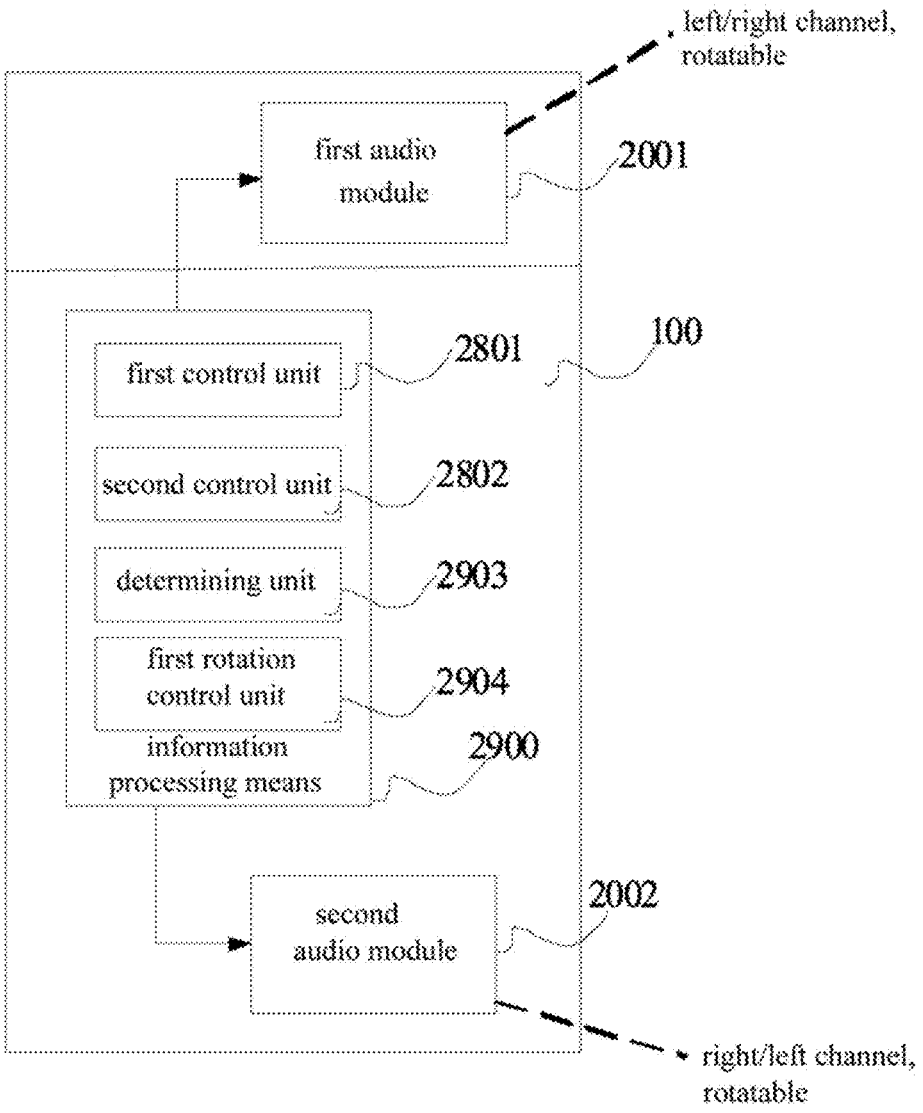
FIG. 29 is a schematic diagram of the structure of another information processing means applied to an electronic device disclosed in the sixth embodiment of the present invention.

As shown in FIG. 29 which is a schematic diagram of the structure of another information processing means disclosed in the sixth embodiment of the present invention, based on the information processing method disclosed in the fourth embodiment of the present invention embodiment, the information processing means 2900 is applied to the electronic device 100, and the electronic device 100 has at least a first audio module 2001 and the second audio module 2002, wherein the first audio module 2001 or the second audio module 2002 can be rotated. The information processing means 2900 mainly includes:

a first control unit 2801, for controlling the first audio module 2001 or the second audio module 2002 to receive a sound signal when the electronic device 100 satisfies a first predetermined condition;

a second control unit 2802, for controlling the first audio module 2001 or the second audio module 2002 to receive an electrical signal and converting it to a sound signal to play when the electronic device 100 satisfies a second predetermined condition;

a determining unit 2903, for, when the electronic device 100 satisfies the second predetermined condition, determining whether the sound outlet directions of the first audio module 2001 and the second audio module 2002 that are currently playing sound signals are consistent, if consistent, returning to execute the second control unit 2802; if not, executing a first control rotation unit 2904;

the first control rotation unit 2904 is for rotating the first audio module 2001 or the second audio module 2002, so as to cause the sound outputting directions of the sound outlets of the first audio module 2001 and the second audio module 2002 to be consistent, then returning to execute the second control unit 2802.

The specific executing process of each of the above modules is the same as the content disclosed in the fourth embodiment of the present invention, no more details repeated herein.

Figure 30:
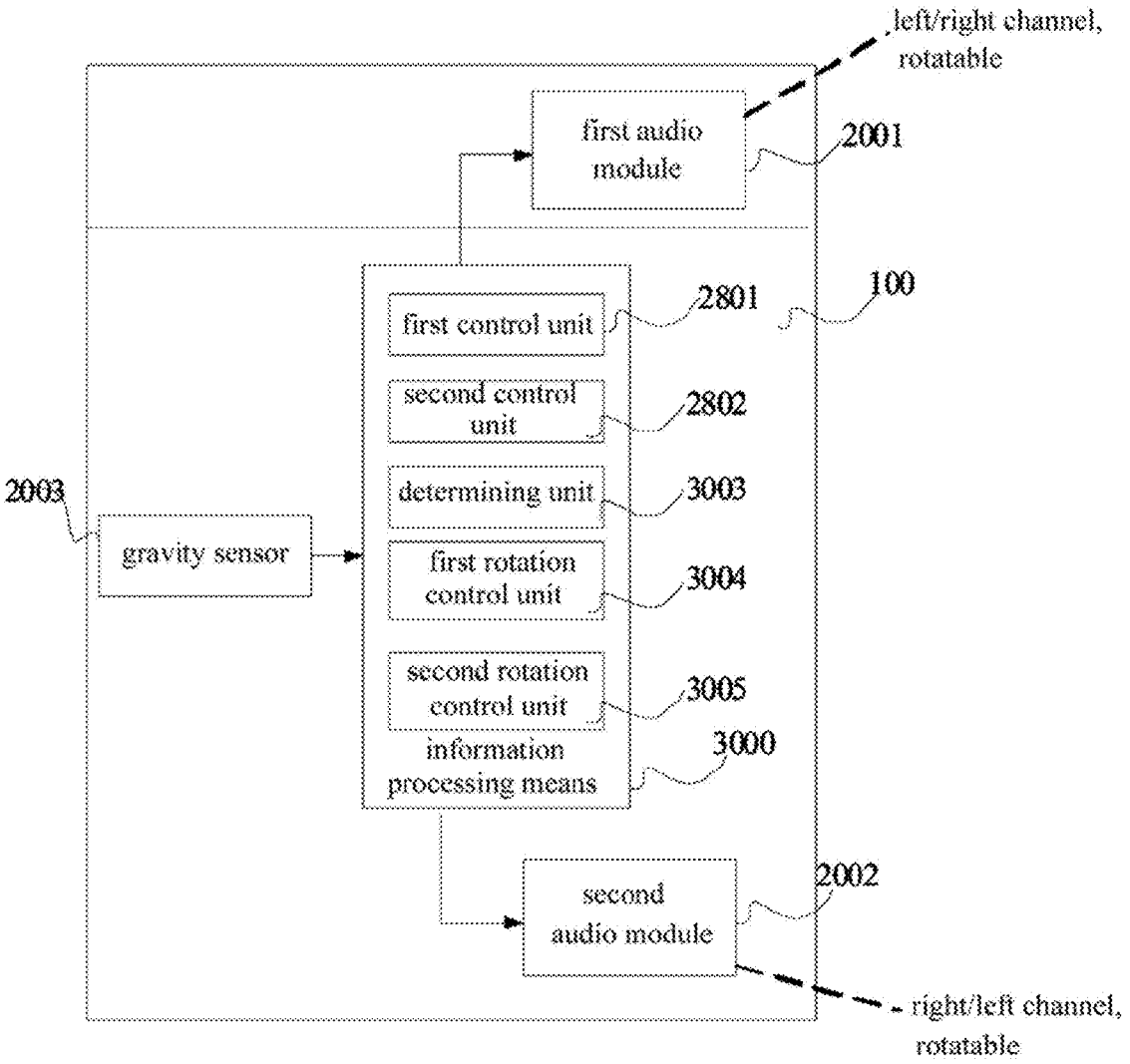
FIG. 30 is a schematic diagram of the structure of yet another information processing means applied to an electronic device disclosed in the sixth embodiment of the present invention.

As shown in FIG. 30 which is a schematic diagram of the structure of yet another information processing means disclosed in the sixth embodiment of the present invention, based on the information processing method disclosed in the fifth embodiment of the present invention embodiment, the information processing means 3000 is applied to the electronic device 100, and the electronic device 100 at least has a first audio module 2001, a second audio module 2002, and a gravity sensor 2003, wherein the first audio module 2001 or the second audio module 2002 can be rotated. The information processing means 3000 mainly includes:

a first control unit 2801, for controlling the first audio module 2001 or the second audio module 2002 to receive a sound signal when the electronic device 100 satisfies a first predetermined condition;

a second control unit 2802, for controlling the first audio module 2001 or the second audio module 2002 to receive an electrical signal and converting it to a sound signal to play when the electronic device 100 satisfies a second predetermined condition;

a determining unit 3003, for, when the electronic device 100 satisfies a second predetermined condition, determining whether the sound outlet directions of the first audio module 2001 and the second audio module 2002 that are currently playing sound signals are consistent, if consistent, returning to execute of the second control unit 2802; if not, executing a first control rotation unit 3004;

the first control rotation unit 3004 is for rotating the first audio module 2001 or the second audio module 2002, so as to cause the sound outputting directions of the sound outlets of the first audio module 2001 and the second audio module 2002 to be consistent, then returning to execute the second control unit 2802;

a second control rotation unit 3005, for rotating the sound outlet direction of the first audio module 2001 and/or that of the second audio module 2002 according to the direction of position of the electronic device 100 as detected by the gravity sensor 2003 within the electronic device 100, so as to cause the directions of the two sound outlets to be consistent with the direction of position of the electronic device.

The specific executing process of each of the above modules is the same as the content disclosed in the fifth embodiment of the present invention, no more details repeated herein.

It should to be noted that, based on the respective information processing means disclosed in the sixth embodiment of the present invention, wherein the second control unit 2802 particularly includes: an allocating sub-unit (not shown) and a control sub-unit (not shown):

the allocating sub-unit is for allocating the first audio module to correspond to a right channel, and the second audio module to correspond to a left channel; or allocating the first audio module to correspond to the left channel, and the second audio module to correspond to the right channel; and the control sub-unit is for controlling sound outlets, to which the first audio module allocated with a channel and the second audio module allocated with a channel correspond, to play the corresponding audio.

Through the above description of the specific application, the sixth embodiment of the present invention employs the electronic device at least having two audio modules that can be rotated, and when a predetermined condition is satisfied, causes the first audio module and the second audio module to be both able to receive electrical signals, convert them to sound signals, and play in the same direction. Stereo playing is achieved without increasing manufacturing cost to the electronic device, setting the first audio module and the second audio module in the same direction can reflect better stereo effect.

Further, based on that the electronic device has a gravity sensor, by detecting and controlling the audio modules and the current position of the electronic device, the sound outlet direction of the first audio module and/or that of the second audio module is made consistent with the direction of the current position of the electronic device, that is, ensuring that the direction of a sound outlet that plays sound information always faces the user, and the sound information is played without being blocked, thus enhancing stereo playing effect.

Further, by the above structures and the information processing modes, internal space is saved for the electronic device, so that the saved space can be used for other purposes, and extension can be made more conveniently.

The information processing methods, the information processing means, and the electronic devices of the above embodiments of as shown in FIGS. 20 to 30 may be used independently, or may also be used in combination with the electronic devices and the direction switching methods thereof as shown in FIGS. 1 to 19.

Each embodiment of the present specification is described in a progressive way, the focus is the difference of each embodiment as compared with other embodiments, and the same or similar parts among the respective embodiments can be referred to with each other. For the means provided in the embodiments, since they correspond to the method disclosed in the embodiments, the descriptions are relatively simple, and please see the method parts for related information.

The above explanations for the disclosed embodiments enable one of skill in the art to implement or use the present invention. Various modifications to these embodiments will be apparent to for one of skill in the art, and the general principles defined herein may be implemented in other embodiments without departing from the spirit or scope of the present invention. Accordingly, the present invention will not be limited to these embodiments shown herein, but to meet the widest scope consistent with the principles and novel features disclosed herein.

What is claimed:

1. An electronic device, said electronic device comprising:

a housing having a first end and a second end;

an audio input means provided within said housing, used for inputting first audio information, and including a first audio input unit; and an audio output means provided within said housing, used for outputting second audio information, and including at least one audio output unit, a direction detecting means for detecting whether said electronic device is in a first working direction in which the direction from said first end to said second end is a reference direction or a second working direction in which the direction from said second end to said first end is the reference direction; and a first transmitting means provided within said housing, and for transmitting said first audio input unit to said second end when said electronic device is in said first working direction; and transmitting said first audio input unit to said first end when said electronic device is in said second working direction.

2. The electronic device according to claim 1, wherein said audio output means includes a first audio output unit for outputting said second audio information in a first volume.

3. The electronic device according to claim 1, wherein said audio output means includes:

a first audio output unit for outputting said second audio information in a first volume when it is in the working state; and a second audio output unit located at said first end, for outputting said second audio information in a second volume when it is in the working state, said switching unit is further for switching said first audio output unit to a non-working state and switching said second audio output unit to the working state when said direction detecting means detects that said electronic device is in said first working direction, so as to output said second audio information; and for switching said second audio output unit to the non-working state and switching said first audio output unit to the working state when said direction detecting means detects that said electronic device is in said second working direction, so as to output said second audio information.

4. The electronic device according to claim 1, wherein said audio output means includes:

a first audio output unit located at said second end, and for outputting said second audio information in a second volume when it is in the working state; and a second audio output unit located at said first end, and for outputting said second audio information in the second volume when it is in the working state, and the electronic device further comprises:

a switching unit for switching said first audio output unit to a non-working state and switching said second audio output unit to the working state when said direction detecting means detects that said electronic device is in said first working direction, so as to output said second audio information; and for switching said second audio output unit to the non-working state and switching said first audio output unit to the working state when said direction detecting means detects that said electronic device is in said second working direction, so as to output said second audio information.

5. The electronic device according to claim 1, wherein said audio output means includes:

a first audio output unit for outputting said second audio information in a second volume, said electronic device further comprises:

a second transmitting means provided within said housing, and for transmitting said first audio output unit to said first end when said electronic device is in said first working direction; and transmitting said first audio output unit to said second end when said electronic device is in said second working direction.

6. The electronic device according to claim 5, wherein said second transmitting means includes:

a slide track provided within said transmitting means and on which said first audio output unit is installed; and a counterweight unit installed on said slide track, and the mass of the counterweight unit is greater than that of said first audio output unit, so that said first audio output unit is dragged to slide on said slide track by using the mass of said counterweight unit, so as to maintain said first audio output unit at said first end while maintaining said counterweight unit at said second end when said electronic device is in said first working direction; and maintain said first audio output unit at said second end while maintaining said counterweight unit at said first end when said electronic device is in said second working direction.

7. The electronic device according to claim 5, wherein said second transmitting means includes:

a containing medium provided within said transmitting means and containing said first audio output unit therein, and in said containing medium, the buoyancy on said first audio output unit is greater than the gravity it has, so that said first audio output unit is maintained at said first end when said electronic device is in said first working direction;

and said first audio output unit is maintained at said second end when said electronic device is in said second working direction.

8. The electronic device according to claim 5, wherein said second transmitting means includes:

an actuator unit provided within the transmitting means and mechanically connected with said first audio output unit, and for transmitting said first audio output unit to said first end along a first track when said direction detecting means detects that said electronic device is in said first working direction; and transmitting said first audio output unit to said second end along a second track when said direction detecting means detects that said electronic device is in said second working direction.

9. The electronic device according to claim 1, wherein said audio output means includes:

a first audio output unit for outputting said second audio information in a second volume, and said first transmitting means is further for transmitting said first audio output unit to said first end when said electronic device is in said first working direction; and transmitting said first audio output unit to said second end when said electronic device is in said second working direction.

10. The electronic device according to claim 9, wherein said first transmitting means includes:

a slide track provided within said transmitting means and on which said first audio input unit and said first audio output unit are installed, the mass of said first audio input unit is greater than that of said first audio output unit, so that said first audio output unit is dragged to slide on said slide track by using the mass of said first audio input unit, so as to maintain said first audio output unit at said first end while maintaining said first audio input unit at said second end when said electronic device is in said first working direction; and maintain said first audio output unit at said second end while maintaining said first audio input unit at said first end when said electronic device is in said second working direction.

11. The electronic device according to claim 9, wherein said first transmitting means includes:

a containing medium provided within said transmitting means and containing said first audio input unit and said first audio output unit therein, in said containing medium, the buoyancy on said first audio input unit is greater than the gravity it has, and the buoyancy on said first audio output unit is greater than the gravity it has, so that said first audio output unit is maintained at said first end while maintaining said first audio input unit at said second end when said electronic device is in said first working direction; and said first audio output unit is maintained at said second end while said first audio input unit is maintained at said first end when said electronic device is in said second working direction.

12. The electronic device according to claim 9, wherein said first transmitting means includes:

an actuator unit provided within said first transmitting means and mechanically connected with said first audio input unit and said first audio output unit, and for transmitting said first audio output unit to said first end along a first track while transmitting said first audio input unit to said second end along a second track when said direction detecting means detects that said electronic device is in said first working direction; and transmitting said first audio output unit to said second end along a second track while transmitting said first audio input unit to said first end along a first track when said direction detecting means detects that said electronic device is in said second working direction.

13. The electronic device according to claim 1, wherein:

said audio input means includes:

a first audio input unit located at said second end, said audio output means includes:

a first audio output unit located at said first end, wherein said first audio input unit is a first audio module, which is capable of receiving an electrical signal and converting it to a sound signal to play, and also receiving a sound signal and converting it to an electrical signal; said first audio output unit is a second audio module, which is capable of receiving an electrical signal and converting it to a sound signal to play, and also receiving a sound signal and converting it to an electrical signal, said electronic device further comprises:

a first control unit for controlling said first audio module or said second audio module to receive the sound signal when said electronic device satisfies a first predetermined condition; and a second control unit for controlling said first audio module or said second audio module to receive the electrical signal and converting it to the sound signal to play when said electronic device satisfies a second predetermined condition.

14. The electronic device according to claim 13, wherein in the case that said first audio module or said second audio module can be rotated, said electronic device further comprises:

a determining unit for, when said electronic device satisfies the second predetermined condition, determining whether the sound outlet directions of said first audio module and said second audio module that are currently playing the sound signals are consistent, if consistent, returning to execute said second control unit; if not, executing a first control rotation unit;

said first control rotation unit is for rotating said first audio module or said second audio module, so as to cause the sound outputting directions of the sound outlets of said first audio module and said second audio module to be consistent, then returning to execute said second control unit.

15. The electronic device according to claim 13, wherein in the case that said first audio module or said second audio module can be rotated, said electronic device further comprises:

a second control rotation unit for rotating the sound outlet direction of said first audio module and/or that of said second audio module according to the direction of position of said electronic device as detected by a gravity sensor within said electronic device, so as to cause the directions of the two sound outlets to be consistent with the direction of position of said electronic device.

16. A direction switching method of the electronic device of claim 1 further comprising:

detecting whether said electronic device is in a first working direction or a second working direction;

transmitting a first audio input unit to a second end when said electronic device is in said first working direction; and transmitting a first audio input unit to a first end when said electronic device is in said second working direction.

17. The method according to claim 16, wherein:

said audio input means includes:

a first audio input unit located at said second end, said audio output means includes:

a first audio output unit located at said first end, wherein said first audio input unit is a first audio module, which is capable of receiving an electrical signal and converting it to a sound signal to play, and also receiving a sound signal and converting it to an electrical signal; said first audio output unit is a second audio module, which is capable of receiving an electrical signal and converting it to a sound signal to play, and also receiving a sound signal and converting it to an electrical signal, the step of transmitting the first audio input unit to at said second end when said electronic device is in said first working direction and transmitting the first audio input unit to said first end when said electronic device is in said second working direction comprises:

controlling said first audio module or said second audio module to receive the sound signal when said electronic device satisfies a first predetermined condition; and controlling said first audio module or said second audio module to receive the electrical signal and converting it to the sound signal to play when said electronic device satisfies a second predetermined condition.

18. The method according to claim 17, wherein said method further comprises: said first audio module or said second audio module can be rotated, the method of controlling the sound outlet of said first audio module or said second audio module to rotate comprises:

determining whether the sound outlet directions of said first audio module and said second audio module that are currently playing the sound signals are consistent when said electronic device satisfies the second predetermined condition, if consistent, using the sound outlets of said first audio module and said second audio module to play the sound signals;

if not, rotating said first audio module or said second audio module to cause the sound outlet direction of said first audio module and that of said second audio module to be consistent.

19. The method according to claim 17, wherein said method further comprises:

rotating the sound outlet direction of said first audio module and/or that of said second audio module according to the direction of position of said electronic device as detected by a gravity sensor within said electronic device when the position of said electronic device changes, to cause the directions of said two sound outlets to be consistent with the direction of position of said electronic.

20. The electronic device according to claim 1, wherein said first transmitting means includes:

a slide track provided within said first transmitting means and on which said first audio input unit is installed; and a counterweight unit installed on said slide track, and the mass of the counterweight unit is smaller than that of said first audio input unit, so that said first audio input unit is dragged to slide on said slide track by using the mass of said counterweight unit, so as to maintain said first audio input unit at said first end while maintaining said counterweight unit at said second end when said electronic device is in said second working direction; and maintain said first audio input unit at said second end while maintaining said counterweight unit at said first end when said electronic device is in said first working direction.

21. The electronic device according to claim 20, wherein said first transmitting means includes:

a containing medium provided within said first transmitting means and containing said first audio input unit therein, and in said containing medium, the buoyancy on said first audio input unit is smaller than the gravity it has, so that said first audio input unit is maintained at said second end when said electronic device is in said first working direction; and said first audio input unit is maintained at said first end when said electronic device is in said second working direction.

22. The electronic device according to claim 20, wherein said first transmitting means includes:

an actuator unit provided within the transmitting means and mechanically connected with said first audio input unit, and for transmitting said first audio input unit to said first end along a first track when said direction detecting means detects that said electronic device is in said second working direction; and transmitting said first audio input unit to said second end along a second track when said direction detecting means detects that said electronic device is in said first working direction.

* * * * *